US012774154B2

(12) United States Patent
Miller

(10) Patent No.: US 12,774,154 B2
(45) Date of Patent: Oct. 27, 2026

(54) NESTING STORMWATER CHAMBER ENDCAPS

(71) Applicant: ADVANCED DRAINAGE SYSTEMS INC., Hilliard, OH (US)

(72) Inventor: Adam Miller, Haddam, CT (US)

(73) Assignee: Advanced Drainage Systems, Inc., Hilliard, OH (US)

( * ) Notice: Subject to any disclaimer, the term of this patent is extended or adjusted under 35 U.S.C. 154(b) by 161 days.

(21) Appl. No.: 18/540,400

(22) Filed: Dec. 14, 2023

(65) Prior Publication Data

US 2025/0197101 A1 Jun. 19, 2025

(51) Int. Cl.
*B65D 90/54* (2006.01)
*B65D 88/76* (2006.01)
*E03F 1/00* (2006.01)

(52) U.S. Cl.
CPC ..... *B65D 90/545* (2013.01); *B65D 88/76* (2013.01); *E03F 1/00* (2013.01); *E03F 1/003* (2013.01)

(58) Field of Classification Search
CPC ..... B65D 90/545; B65D 88/76; E03F 1/00; E03F 1/002; E03F 1/003
USPC ..... 405/46, 49
See application file for complete search history.

(56) References Cited

U.S. PATENT DOCUMENTS 980,442 A 1/1911 Schlafly
3,611,728 A 10/1971 Vant Hof
3,744,254 A 7/1973 Fennelly
4,245,924 A 1/1981 Parker et al.
4,246,936 A 1/1981 Luz
4,359,167 A 11/1982 Parker et al.
4,523,613 A 6/1985 Child, Jr. et al.
4,625,302 A 11/1986 Clark
(Continued)

FOREIGN PATENT DOCUMENTS

CA 2535015 A1 1/2009
CN 110409588 A 11/2019
(Continued)

OTHER PUBLICATIONS

International Search Report and Written Opinion of the International Searching Authority in International Application No. PCT/US2024/059858, dated Mar. 24, 2025, 14 pages.
(Continued)

*Primary Examiner* — Amber R Anderson
(74) *Attorney, Agent, or Firm* — FINNEGAN, HENDERSON, FARABOW, GARRETT & DUNNER L.L.P.

(57) ABSTRACT

Consistent with disclosed embodiments, a stackable endcap of a chamber for holding and discharging stormwater may be provided. The stackable endcap may include an endcap body having a wall with a convex outer surface and a concave inner surface, the concave inner surface of the wall defining an interior volume of the stackable endcap; a substantially planar foot extending from a lower edge of the endcap body; and a protruding inner rim running along an inner edge of the endcap body. The stackable endcap may be configured to be stacked with at least one additional endcap such that at least one of the foot or the inner rim of the stackable endcap contacts the additional endcap while the wall of the endcap body is spaced apart from a wall of the additional endcap.

22 Claims, 26 Drawing Sheets

(56) References Cited

U.S. PATENT DOCUMENTS 4,759,661 A 7/1988 Nichols et al.
4,824,287 A 4/1989 Tracy
5,017,041 A 5/1991 Nichols
5,065,554 A 11/1991 Neva et al.
5,087,151 A 2/1992 DiTullio
5,129,758 A 7/1992 Lindstrom
5,156,488 A 10/1992 Nichols
5,361,930 A 11/1994 Perry
5,401,459 A 3/1995 Nichols et al.
5,419,838 A 5/1995 DiTullio
5,441,363 A 8/1995 Gray
5,498,104 A 3/1996 Gray
5,511,903 A 4/1996 Nichols et al.
5,556,231 A 9/1996 Hamilton et al.
5,588,778 A 12/1996 Nichols et al.
D403,047 S 12/1998 Gray
5,890,837 A 4/1999 Wells
5,890,838 A 4/1999 Moore, Jr.
6,076,993 A 6/2000 Gray
6,322,288 B1 11/2001 Ditullio
6,350,374 B1 2/2002 Urbonas et al.
D474,524 S 5/2003 Benecke
D474,525 S 5/2003 Benecke
6,567,341 B2 5/2003 Gunderson et al.
D477,381 S 7/2003 Benecke
6,602,023 B2 8/2003 Crescenzi et al.
6,679,653 B1 1/2004 DiTullio
6,698,975 B1 3/2004 Benecke
6,783,683 B2 8/2004 Collings
6,854,925 B2 2/2005 Ditullio
6,991,734 B1 1/2006 Coppes et al.
7,118,306 B2 * 10/2006 Kruger ..... E03F 1/003 405/126
7,126,875 B2 10/2006 Baskerville et al.
7,134,808 B2 11/2006 King et al.
7,160,059 B2 1/2007 Gray et al.
D537,912 S 3/2007 Benecke
D538,387 S 3/2007 Benecke
D538,388 S 3/2007 Benecke
D538,882 S 3/2007 Benecke
7,226,241 B2 6/2007 DiTullio
7,237,981 B1 7/2007 Vitarelli
D549,836 S 8/2007 Desbiens
7,300,226 B1 11/2007 Maestro
7,306,399 B1 * 12/2007 Smith ..... E03F 1/003 405/40
D566,852 S 4/2008 Gaster
7,351,005 B2 4/2008 Potts
7,364,384 B1 4/2008 Swistak
7,384,212 B2 6/2008 Currivan
7,419,332 B1 9/2008 Brochu
7,473,053 B1 1/2009 Brochu et al.
7,500,805 B1 3/2009 Brochu
7,611,306 B1 11/2009 Brochu et al.
7,614,825 B2 11/2009 Kroger
7,637,691 B1 12/2009 Ditullio
D613,819 S 4/2010 Ditullio
7,798,747 B1 9/2010 de Bruijn et al.
7,806,627 B2 10/2010 Ditullio
D638,094 S 5/2011 Ditullio
D638,095 S 5/2011 Ditullio
8,007,201 B2 8/2011 Currivan
8,070,005 B1 12/2011 Kruger
D653,352 S 1/2012 Jacques et al.
D668,318 S 10/2012 Ditullio
8,366,346 B2 2/2013 Ditullio
8,414,222 B2 4/2013 Ditullio
8,425,148 B2 4/2013 Ditullio
8,636,444 B2 1/2014 Currivan
8,672,583 B1 3/2014 Gandhi et al.
8,740,005 B1 6/2014 Holbrook
8,857,641 B1 10/2014 Moore, Jr.
8,858,119 B2 10/2014 Wynne
8,955,258 B2 2/2015 Kucera et al.
D728,825 S 5/2015 Miskovich
D737,927 S 9/2015 DiTullio
9,255,394 B2 2/2016 Gandhi et al.
9,260,854 B1 2/2016 Moore, Jr.
9,290,924 B2 3/2016 Wynne
D753,262 S 4/2016 DiTullio
9,410,403 B2 8/2016 Patterson et al.
9,580,898 B2 2/2017 Wynne
D791,272 S 7/2017 DiTullio
D792,552 S 7/2017 DiTullio
9,765,509 B1 9/2017 DiTullio
9,809,968 B1 11/2017 Coppes et al.
D806,827 S 1/2018 Kuehn et al.
9,982,425 B2 5/2018 Vitarelli et al.
D820,384 S 6/2018 DiTullio
D832,393 S 10/2018 Gera et al.
10,138,714 B2 11/2018 Ward
D840,499 S 2/2019 Gera et al.
10,442,617 B1 10/2019 Holbrook
10,544,575 B1 1/2020 DiTullio
10,640,407 B1 5/2020 Holbrook
10,794,032 B2 10/2020 Jung et al.
11,028,569 B2 6/2021 Spires et al.
11,242,677 B2 2/2022 Gandhi et al.
11,377,835 B2 7/2022 Vitarelli et al.
11,555,561 B2 1/2023 Atchison et al.
11,624,179 B2 4/2023 Vitarelli et al.
11,691,894 B2 7/2023 Vitarelli et al.
11,725,376 B2 * 8/2023 Mailhot ..... E03F 1/00 405/42
2002/0025226 A1 2/2002 Maestro
2002/0044833 A1 4/2002 Kruger
2003/0095838 A1 5/2003 Maestro
2003/0228194 A1 * 12/2003 Ring ..... E03F 1/002 405/36
2004/0184884 A1 9/2004 DiTullio
2005/0074285 A1 4/2005 Burnes
2005/0074287 A1 4/2005 Brochu
2005/0074288 A1 4/2005 Moore
2005/0111915 A1 5/2005 Moore
2005/0238434 A1 10/2005 Coppes
2007/0081860 A1 * 4/2007 Goddard ..... E03F 1/003 138/121
2007/0258770 A1 11/2007 Miskovich
2008/0181725 A1 7/2008 Miskovich
2008/0226394 A1 9/2008 Coppes
2008/0240859 A1 10/2008 Sipaila
2008/0290538 A1 * 11/2008 Biesenberger ..... B29C 48/92 425/149
2009/0220302 A1 9/2009 Cobb
2010/0059430 A1 3/2010 Adams
2011/0100493 A1 * 5/2011 Cislo ..... F16L 55/1157 29/525
2011/0200391 A1 * 8/2011 Mailhot ..... E03F 1/003 405/42
2015/0211198 A1 * 7/2015 Mailhot ..... E02B 11/00 405/49
2015/0240471 A1 * 8/2015 Pank ..... E03F 5/14 210/170.03
2016/0160487 A1 6/2016 Wynne
2017/0089054 A1 * 3/2017 Mailhot ..... E03F 1/003
2018/0038090 A1 * 2/2018 DiTullio ..... B29C 44/02
2020/0032499 A1 1/2020 Mailhot et al.
2020/0263409 A1 * 8/2020 Spires ..... E03F 1/003
2020/0333490 A1 * 10/2020 Hegna ..... G01V 1/364
2020/0354943 A1 * 11/2020 Spires ..... E03F 5/106
2021/0285203 A1 * 9/2021 Spires ..... E03F 1/003
2022/0281756 A1 * 9/2022 Figola ..... B01D 24/00
2023/0257984 A1 * 8/2023 Coppes ..... E03F 3/04 405/36
2023/0264977 A1 * 8/2023 Figola ..... B01D 24/00 210/162
2023/0286828 A1 * 9/2023 Figola ..... C02F 9/00
2023/0340770 A1 * 10/2023 Mailhot ..... E03F 1/00

FOREIGN PATENT DOCUMENTS

EP 0780524 A1 6/1997
EP 2884015 A1 * 6/2015 ..... E03F 1/003

(56) References Cited

FOREIGN PATENT DOCUMENTS

| | | | | | |
|---|---|---|---|---|---|
| EP | 2902555 | A1 | | 8/2015 | |
| EP | 2902555 | B1 | * | 12/2016 | ..... E03F 1/003 |
| WO | 2008121890 | A1 | | 10/2008 | |
| WO | 2020023970 | A1 | | 1/2020 | |

OTHER PUBLICATIONS

International Search Report and Written Opinion of the International Searching Authority in International Application No. PCT/US2019/043972, dated Feb. 2, 2021 (13 pages).
Advanced Drainage Systems, "StormTech Product Catalog," accessed from <https://www.adspipe.com/resources/documents/9D8F881D-5DC0-4DB9-AF85142118AEE3E6> (Aug. 2023) (28 pages).

* cited by examiner

NESTING STORMWATER CHAMBER ENDCAPS

TECHNICAL FIELD

This disclosure relates generally to stormwater drainage systems, and more particularly, to endcaps for stormwater chambers and methods for making and using endcaps for stormwater chambers.

BACKGROUND

Stormwater management systems are used to manage and control stormwater, for example, by providing stormwater chambers for retention of stormwater. As such, one or multiple stormwater chambers may be provided (e.g., underground) where the chambers capture, filter, and/or contain the stormwater until it is exfiltrated into the ground or drained to an off-site location. A stormwater chamber may often include a hollow, elongated chamber body with a central cavity for receiving fluids. An opening on the bottom and/or louvers on the sides allow fluids to exit the chamber and disperse into the surrounding earth. Endcaps may be attached to one or both ends of the chamber body to form a closed chamber. The chamber endcaps prevent entry of gravel, earth, or other particulates that would disrupt the filter and drainage functionality of the chamber.

Existing endcaps are difficult to transport since they cannot be efficiently stacked or nested together without damaging one or more of the endcaps. As a result, endcaps must be moved and stored individually, creating redundant work for shippers and taking up valuable space in storage facilities and transportation vehicles. Accordingly, a need exists for stormwater chamber endcaps that can be securely nested together in a manner that takes up minimal space and which does not damage any of the nested endcaps.

SUMMARY

Consistent with disclosed embodiments, systems, assemblies, apparatuses, and methods for holding and discharging stormwater are disclosed. According to an embodiment of the present disclosure, a stackable endcap of a chamber for holding and discharging stormwater is provided. The stackable endcap includes an endcap body having a wall with a convex outer surface and a concave inner surface, the concave inner surface of the wall defining an interior volume of the stackable endcap; a substantially planar foot extending from a lower edge of the endcap body; and a protruding inner rim running along an inner edge of the endcap body. The stackable endcap is configured to be stacked with at least one additional endcap such that at least one of the foot or the inner rim of the stackable endcap contacts the additional endcap while the wall of the endcap body is spaced apart from a wall of the additional endcap.

In disclosed embodiments, the stackable endcap is configured to connect to an end of a chamber body in at least one of an overlapping configuration or an underlapping configuration to form the chamber. In disclosed embodiments, the stackable endcap and the at least one additional endcap are stackable in a vertical stacking direction or in a horizontal stacking direction. In disclosed embodiments, the interior volume of the stackable endcap communicates with an interior volume of the additional endcap when the stackable endcap and the additional endcap are stacked together. In disclosed embodiments, the stackable endcap is configured to receive, within the interior volume, an outer surface of the additional endcap when the stackable endcap and the additional endcap are stacked together. In disclosed embodiments, the stackable endcap additionally includes a plurality of nesting ribs extending from the wall of the endcap body, the nesting ribs being configured to hold the wall of the endcap body apart from the wall of the additional endcap. In disclosed embodiments, at least one of the nesting ribs runs along the concave inner surface of the wall of the endcap body between the foot and the inner rim of the endcap. In disclosed embodiments, the stackable endcap additionally includes at least one nesting rib extending from the wall of the endcap body, the at least one nesting rib being configured to support a third endcap stacked adjacent to the stackable endcap. In disclosed embodiments, the stackable endcap additionally includes a plurality of mounting rings protruding from at least one of the convex outer surface of the wall of the endcap body or the concave inner surface of the wall of the endcap body, each mounting ring being configured to hold a fluid pipe extending through an opening in the stackable endcap. In disclosed embodiments, the mounting rings are arranged in a concentric configuration. In disclosed embodiments, a depth of at least one mounting ring, relative to the wall of the endcap body, varies as a function of position along the wall of the endcap body. In disclosed embodiments, the stackable endcap additionally includes at least one latch extending from the endcap, the at least one latch being configured to engage with a receiving projection of the additional endcap so as to secure the stackable endcap against movement relative to the additional endcap. In disclosed embodiments, the stackable endcap includes at least two latches that are spaced apart from the lower end of the endcap and which each extend from the inner rim in a laterally inward direction. In disclosed embodiments, the wall of the endcap body has a parabolic profile in at least one dimension. In disclosed embodiments, the wall of the endcap body has a parabolic profile in two dimensions. In disclosed embodiments, the concave inner surface of the endcap body wall and the convex outer surface of the endcap body wall are substantially flat. In disclosed embodiments, the wall of the endcap body forms a plurality of corrugations defined by alternating peaks and valleys emanating from the lower edge of the endcap body to the inner edge of the endcap body, the peaks and valleys having parabolic profiles in two dimensions. In disclosed embodiments, at least one of the corrugation valleys has a variable width. In disclosed embodiments, at least one of the corrugation peaks has a variable width. In disclosed embodiments, the stackable endcap additionally includes a plurality of nesting ribs running laterally across the corrugation valleys, the nesting ribs being configured to support a third endcap stacked adjacent to the stackable endcap.

According to another embodiment of the present disclosure, a system for holding and discharging stormwater is provided. The system includes a stormwater chamber formed from a chamber body and a stackable endcap connected to an end of the chamber body. The stackable endcap includes an endcap body having a wall with a convex outer surface and a concave inner surface, the concave inner surface of the wall defining an interior volume of the stackable endcap that is open to an interior volume of the chamber; a substantially planar foot extending from a lower edge of the endcap body; and a protruding inner rim running along an inner edge of the endcap body. The stackable endcap is configured to be stacked with at least one additional endcap such that at least one of the foot or the inner rim of the stackable endcap contacts the additional endcap while the wall of the endcap body is spaced apart from a wall of the additional endcap.

In disclosed embodiments, the system additionally includes a fluid pipe extending through an opening in the endcap body of the stackable endcap. The stackable endcap includes a plurality of mounting rings protruding from at least one of the outer surface of the wall or the inner surface of the wall. One of the mounting rings encircles and holds the fluid pipe.

The forgoing summary provides certain examples of disclosed embodiments to provide a flavor for this disclosure and is not intended to summarize all aspects of the disclosed embodiments. Additional features and advantages of the disclosed embodiments will be set forth in part in the description that follows, and in part will be apparent from the description, or may be learned by practice of the disclosed embodiments. The features and advantages of the disclosed embodiments will be realized and attained by the elements and combinations particularly pointed out in the appended claims.

It is to be understood that both the foregoing general description and the following detailed description are examples and explanatory only and are not restrictive of the disclosed embodiments as claimed.

The accompanying drawings constitute a part of this specification. The drawings illustrate several embodiments of the present disclosure and, together with the description, serve to explain the principles of the disclosed embodiments as set forth in the accompanying claims.

BRIEF DESCRIPTION OF THE DRAWINGS

The accompanying drawings, which are incorporated in and constitute a part of this specification, illustrate disclosed embodiments and, together with the description, serve to explain the disclosed embodiments.

DETAILED DESCRIPTION

Figure 1A:
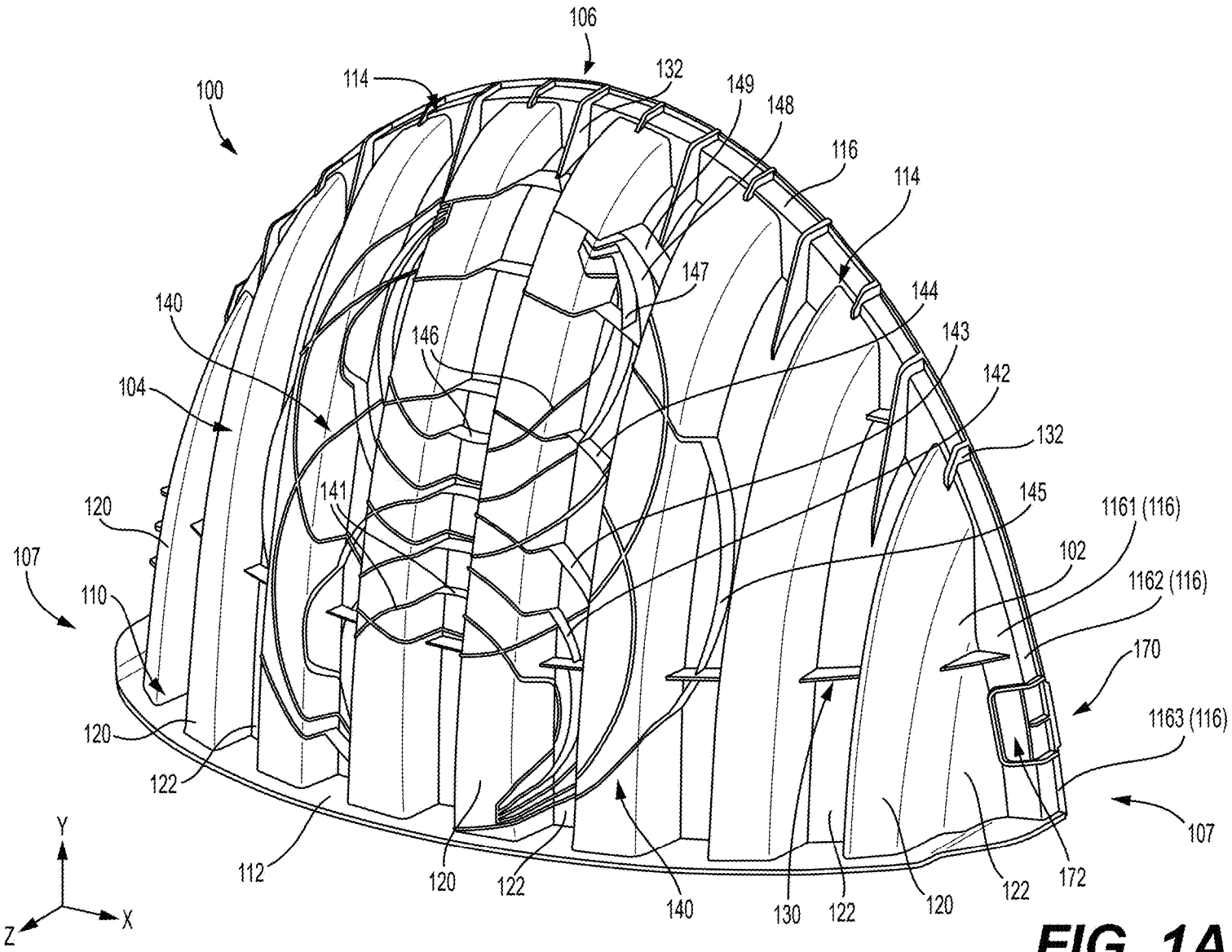
FIG. 1A is a front, top, right perspective view of an example of an endcap of a stormwater chamber, consistent with disclosed embodiments.

Examples of embodiments are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. Also, the words "comprising," "having," "containing," and "including," and other similar forms are intended to be equivalent in meaning and be open ended in that an item or items following any one of these words is not meant to be an exhaustive listing of such item or items or meant to be limited to only the listed item or items. It should also be noted that as used in the present disclosure and in the appended claims, the singular forms "a," "an," and "the" include plural references unless the context clearly dictates otherwise.

As used herein, the phrases "for example," "such as," "for instance" and variants thereof describe non-limiting embodiments of the presently disclosed subject matter. Reference in the specification to features of "embodiments," "examples," "one case," "some cases," "other cases" or variants thereof means that a particular feature, structure or characteristic described may be included in at least one embodiment of the presently disclosed subject matter. Thus the appearance of such terms does not necessarily refer to the same embodiment(s). As used herein, the term "and/or"

includes any and all combinations of one or more of the associated listed items. As used herein, the expression "at least one of . . . or" may include each listed item individually or any combination of the listed items. For example, the expression "at least one of A, B, or C" may include any of A, B, or C alone or any combination of A, B, and C (e.g., A+B, A+C, B+C, or A+B+C).

Features of the presently disclosed subject matter, are, for brevity, described in the context of particular embodiments. However, it is to be understood that features described in connection with one embodiment are also applicable to other embodiments. Likewise, features described in the context of a specific combination may be considered separate embodiments, either alone or in a context other than the specific combination.

Examples of the presently disclosed subject matter are not limited in application to the details of construction and the arrangement of the components set forth in the following description or illustrated in the drawings. The subject matter may be practiced or carried out in various ways. Also, it is to be understood that the phraseology and terminology employed herein is for the purpose of description and should not be regarded as limiting.

In this document, an element of a drawing that is not described within the scope of the drawing and is labeled with a numeral that has been described in a previous drawing may have the same use and description as in the previous drawings.

The drawings in this document may not be to any scale. Different figures may use different scales and different scales can be used even within the same drawing, for example different scales for different views of the same object or different scales for the two adjacent objects.

Figure 1B:
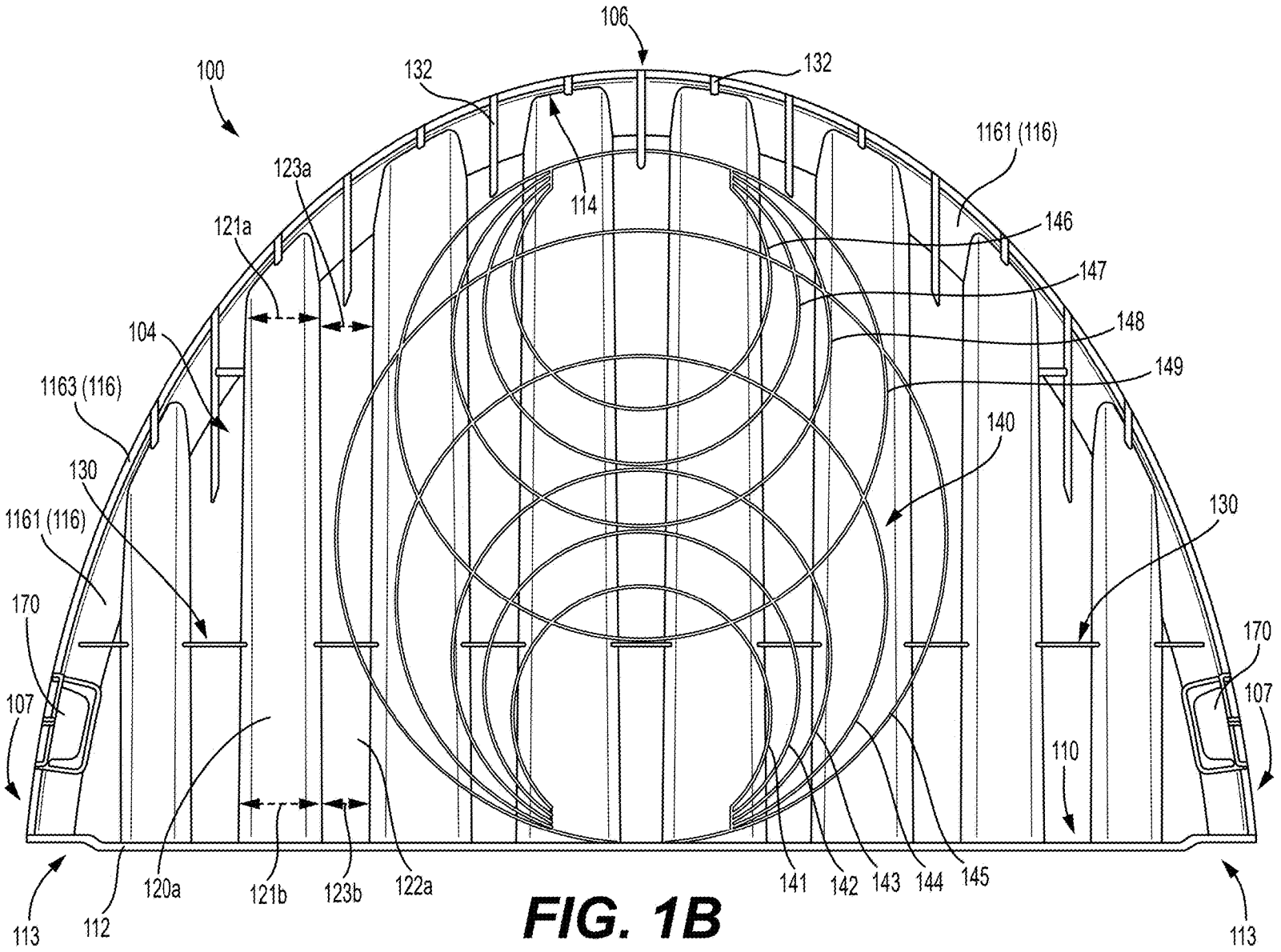
FIG. 1B is a front elevation view of the endcap of FIG. 1A, consistent with disclosed embodiments.
Figure 1C:
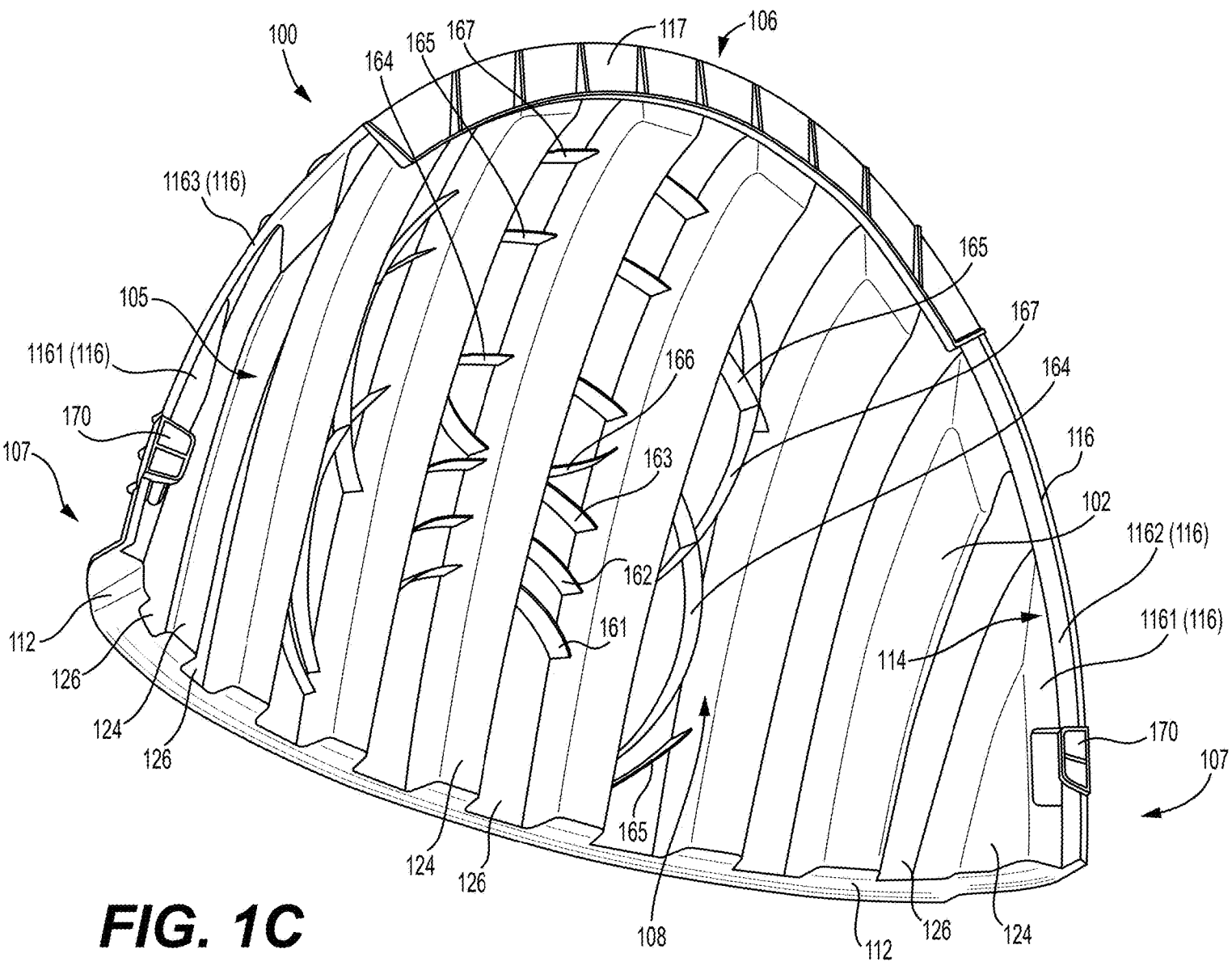
FIG. 1C is a rear, bottom, right perspective view of the endcap of FIG. 1A, consistent with disclosed embodiments.
Figure 1D:
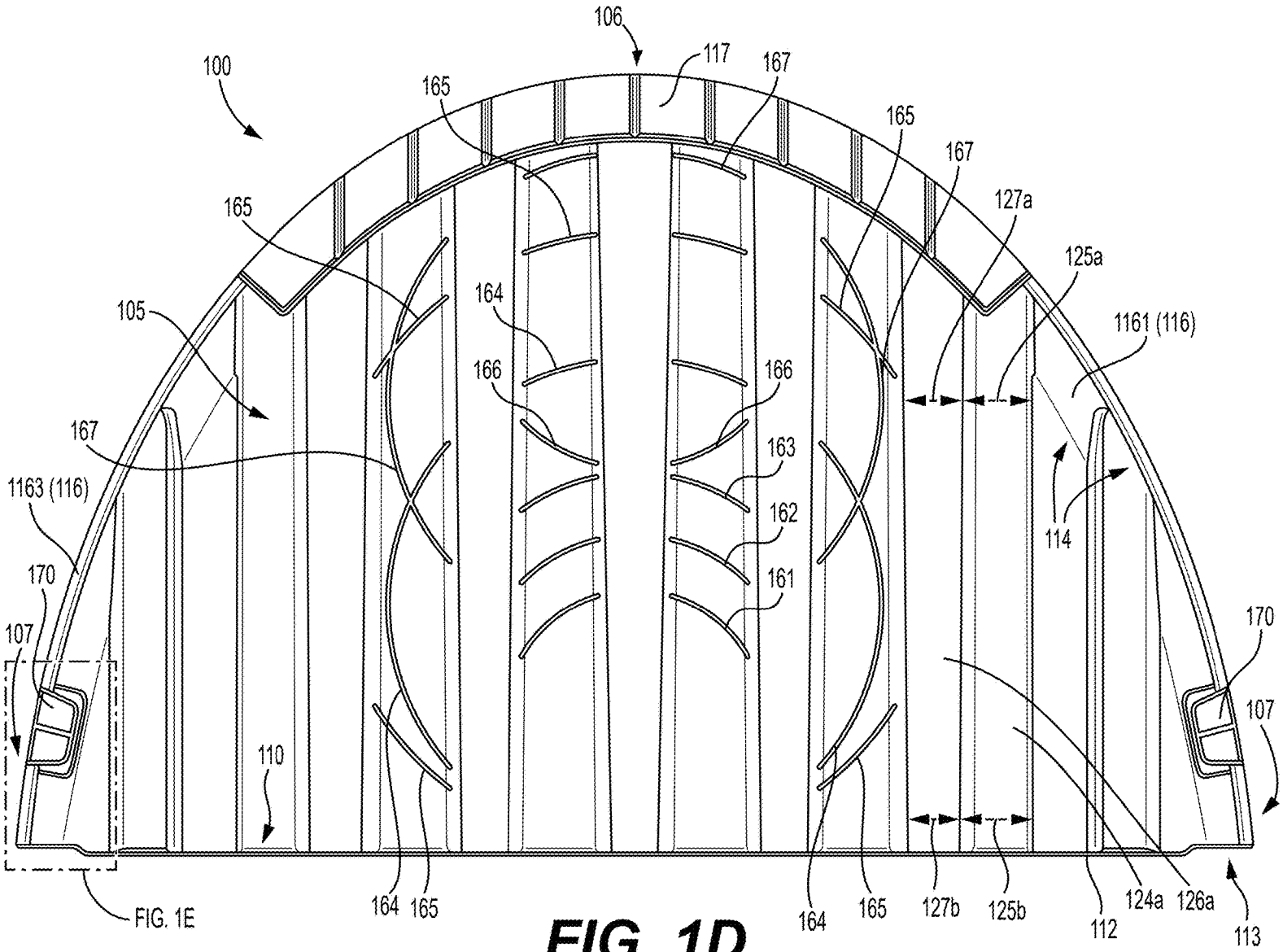
FIG. 1D is a rear elevation view of the endcap of FIG. 1A, consistent with disclosed embodiments.

FIGS. 1A-1F depict a first example of a stackable endcap 100 for a stormwater chamber. Endcap 100 may include an endcap body 102 having a curved wall with a convex outer surface 104 (depicted in FIGS. 1A and 1B) and a concave inner surface 105 (depicted in FIGS. 1C and 1D). As shown in FIG. 1C, the concave inner surface 105 of the endcap body defines an interior volume 108. Endcap 100 may additionally include a foot 112 extending from a lower edge 110 of the endcap body. Endcap foot 112 may be substantially planar, such that some or all of foot 112 is flat with a constant thickness. In some embodiments, and as shown in FIGS. 1B and 1D, endcap foot 112 may include indents 113 at one or both ends to allow the endcap 100 to attach to a stormwater chamber in an overlapping configuration (discussed in detail below). Endcap 100 may additionally include a protruding inner rim 116 running along an inner edge 114 of the endcap body. In some embodiments, inner rim 116 may include a first surface 1161 that is perpendicular to, or substantially perpendicular to, endcap foot 112; a second surface 1162 facing outward from the endcap 100; and an upstanding lip 1163 along an edge of the second surface 1162. In some embodiments, and as shown in FIGS. 1A and 1B, endcap 100 may include one or more reinforcing ribs 132 that extend vertically (or substantially vertically) between the endcap body 102 and the second surface 1162 of inner rim 116; reinforcing ribs 132 may reinforce inner rim 116 against deformation and breaks. Additionally, or alternatively, and as shown in FIGS. 1C and 1D, inner rim 116 may include one or more latching teeth 117 on its inner side (i.e., latching teeth 117 may be situated on the side of upstanding lip 1163 that is visible in the rear elevation view of FIG. 1D). Latching teeth 117 may be configured to latch onto a stormwater chamber to secure the endcap 100 to the chamber (as discussed in detail below).

In some embodiments, endcap 100 may have a width (along the x-direction) within a range between 10 inches and 125 inches. For example, one non-limiting embodiment of endcap 100 may have a width of between 60 inches and 100 inches. Alternatively, the width of endcap 100 may be larger or smaller. In some embodiments, endcap 100 may have a height (along the y-direction) within a range between 8 inches and 80 inches. For example, one non-limiting embodiment of endcap 100 may have a height of between 40 inches and 70 inches. Alternatively, the height of endcap 100 may be larger or smaller. In some embodiments, endcap 100 may have a depth (along the z-direction) within a range between 3 inches and 45 inches. For example, one non-limiting embodiment of endcap 100 may have a depth of between 20 inches and 42 inches. Alternatively, the depth of endcap 100 may be larger or smaller.

In the embodiment shown in FIGS. 1A-1F, the endcap 100 may be corrugated such that one or both of the outer surface 104 and inner surface 105 are contoured. That is, the wall of the endcap body 102 may form a plurality of corrugations defined by alternating peaks and valleys. On outer surface 104 (FIGS. 1A and 1B), the corrugations may form alternating peaks 120 and valleys 122. Similarly, on inner surface 105 (FIGS. 1C and 1D), the corrugations may form alternating peaks 124 and valleys 126. In disclosed embodiments, the corrugations may cover the entire endcap body 102, such that the corrugations emanate from the lower edge 110 of the endcap body to the inner edge 114 of the endcap body. Alternatively, the corrugations may cover only a fraction of the endcap body 102. In some embodiments, a given corrugation in the endcap wall may form a peak 120 on the outer surface 104 and a valley 126 at the same location on the inner surface 105. Similarly, another corrugation in the endcap wall may form a valley 122 on the outer surface 104 and a peak 124 at the same location on the inner surface 105.

In disclosed embodiments, the corrugation peaks and valleys may be flared or tapered, such that the widths of the peaks and valleys vary along the vertical dimension of the endcap 100. For example, FIG. 1B depicts a corrugation peak 120*a* and a corrugation valley 122*a* on the outer surface 104 of the endcap. Peak 120*a* may have a variable width, such that a first peak width 121*a* near inner edge 114 is smaller (i.e., narrower) than a second peak width 121*b* near lower edge 110. Valley 122*a* may also have a variable width, with a first valley width 123*a* near inner edge 114 that is larger (i.e., wider) than a second valley width 123*b* near lower edge 110. Similarly, FIG. 1D depicts a corrugation peak 124*a* and a corrugation valley 126*a* on the inner surface 105 of the endcap. Peak 124*a* may have a variable width, such that a first peak width 125*a* near inner edge 114 is larger (i.e., wider) than a second peak width 125*b* near lower edge 110. Similarly, valley 126*a* may also have a variable width, with a first valley width 127*a* near inner edge 114 that is smaller (i.e., narrower) than a second valley width 127*b* near lower edge 110.

In some embodiments, the magnitude of the flare or taper (i.e., the variation in width of a given corrugation peak or corrugation valley) may be greatest at the center 106 of the endcap and may gradually decrease as you move away from the center 106 and towards the outer ends 107 of the endcap. Thus, a corrugation valley 122 near the center 106 of the endcap may have a larger variation in width, compared to a corrugation valley 122 near an outer end 107 of the endcap, which may have a smaller variation in width. Advantageously, the aforementioned taper of the corrugation peaks and valleys improves the distribution of external forces applied to the endcap, thus making the outer-most parts of the endcap (such as outer ends 107, inner edge 114, and lower edge 110) more resilient and less prone to deformation and breakage. For example, the corrugation taper makes the endcap 100 more resistant to racking, which is a phenomenon in which a structure tilts or buckles to the side when subjected to a non-normal (e.g., horizontally-directed) force. Specifically, a tapered structure has a larger moment of inertia compared to a similar non-tapered or rectangular structure. As a result, the critical buckling load is greater for the tapered corrugations, such that a larger applied force is needed to cause the tapered corrugations to buckle.

In some embodiments, the endcap may include exterior and/or interior ribs to improve structural integrity of the endcap. In the example shown in FIGS. 1A and 1B, endcap 100 may include at least one nesting rib 130 extending from the outer surface 104 of the wall of the endcap body 102. For example, the endcap 100 may include a plurality of nesting ribs 130, which may be situated within some or all of the outer surface corrugation valleys 122. Nesting ribs 130 may extend laterally across the entire width of each of the corrugation valleys 122 and may be arranged in a horizontal line extending laterally across the outer surface 104 (see FIG. 1B). Nesting ribs 130 may reinforce the endcap body 102 against deformation and breakage caused by external loads applied to the endcap. Additionally, and as discussed in further detail below, one or more of nesting ribs 130 may support a second endcap stacked adjacent to endcap 100.

Figure 1E:
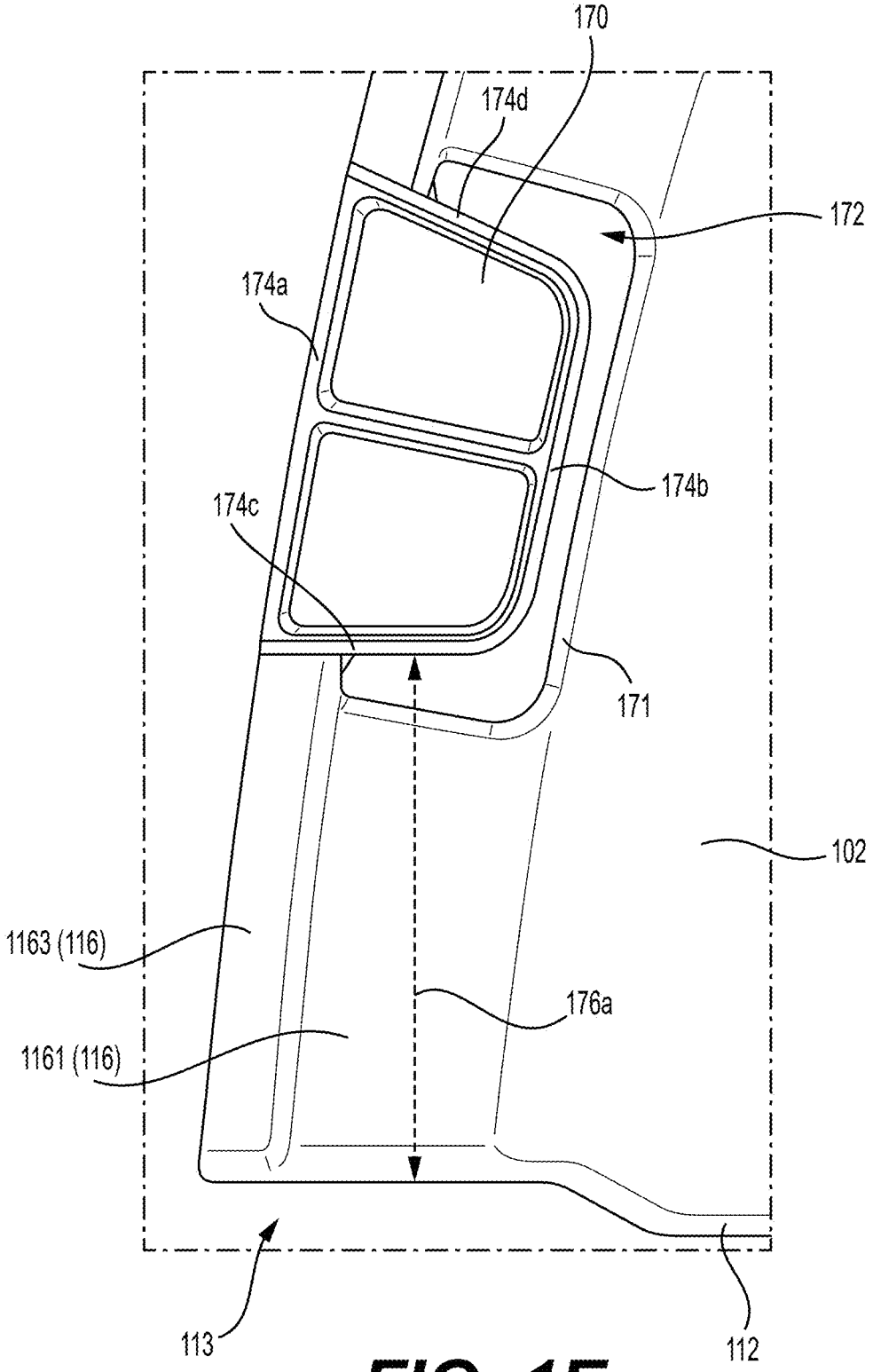
FIG. 1E is an enlarged elevation view of a latch of the endcap, as indicated in FIG. 1D.

In disclosed embodiments, endcap 100 may include at least one latch 170 extending from inner rim 116 of the endcap. As shown in FIG. 1C, endcap 100 may include two latches 170 on opposite ends of inner rim 116. In disclosed embodiments, latches 170 may extend from the lip 1163 of the rim in a laterally inward direction, towards the interior volume 108 of the endcap. In some embodiments, latches 170 may be identical or substantially identical (though oriented in opposite directions). In some embodiments, endcap 100 may include more or fewer than two latches 170. Alternatively, one or more of latches 170 may have different shapes or configurations. As shown in FIGS. 1A and 1E, endcap 100 may additionally include an opening 172 in proximity to each of latches 170. Openings 172 may be used as handles for manipulating endcap 100.

FIG. 1E depicts an enlarged elevation view of one of latches 170. Additionally, FIG. 1E also depicts opening 172, which may be bounded (at least in part) by a lip 171. As discussed in detail below, each latch 170 may be shaped and configured to engage with a second endcap so as to secure endcap 100 against movement relative to the second endcap. In the example shown, latch 170 may be substantially trapezoidal, with an inner edge 174*a* connected to lip 1163 of the inner rim and with an outer edge 174*b* that is shorter in length than inner edge 174*a*, and with side edges 174*c* and 174*d* extending at angle between the inner and outer edges. Alternatively, latch 170 may have a different shape (e.g., a rectangular or square shape). In some embodiments, latch 170 may be spaced apart from the lower end of the endcap 100 by a non-zero vertical distance 176*a*. In alternative embodiments, one or more of the latches 170 may have a different shape and/or configuration.

Figure 1F:
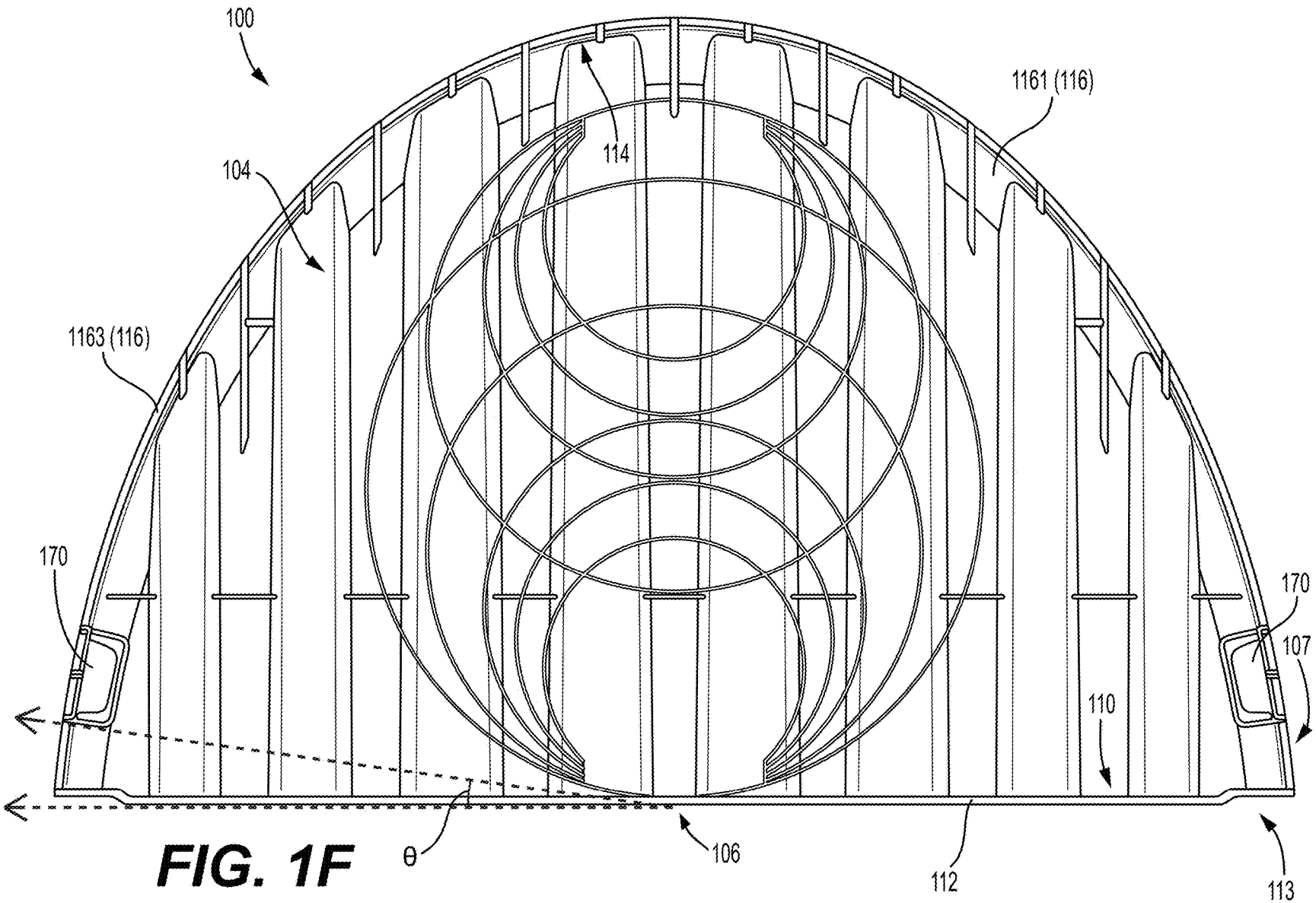
FIG. 1F is another front elevation view of the endcap of FIG. 1A, consistent with disclosed embodiments.

FIG. 1F depicts another front elevation view of endcap 100. As noted above, at least one of the latches 170 may be spaced apart from the lower-most end of endcap 100. For example, at least one of the latches 170 may be situated such that an angle θ is defined between the latch 170 and the lower-most end of endcap 100. In a non-limiting embodiment, angle θ may be between 5-degrees and 15-degrees. For example, angle θ may equal, or substantially equal, 8-degrees, 9-degrees, 10-degrees, or some other value. Advantageously, and as discussed further below in reference to FIGS. 4A-4D, providing the aforementioned angle θ for endcap 100 may provide maximal stacking efficiency (with minimal clearance between adjacent endcaps) while still securely stacking the endcaps together and also preventing the stacked endcaps from damaging each other.

In disclosed embodiments, the endcap may include a plurality of mounting rings protruding from outer side 104 of the endcap wall and/or from inner side 105 of the endcap wall. The mounting rings may be configured to securely hold pipes of various diameters passing through an opening in the endcap. Additionally, the mounting rings may increase the structural integrity of endcap 100, as compared to designs without mounting rings. FIGS. 1A and 1B depict a plurality of mounting rings 141-149 protruding out from outer surface 104 of endcap body 102. Additionally, FIGS. 1C and 1D depict a plurality of mounting rings 161-167 protruding out from inner surface 105 of endcap body 102. Mounting rings 141-149 and 161-167 may be constructed from the same material as endcap body 102 or, alternatively, from a different material. Each mounting ring may be formed from segments disposed in corrugation valleys 122 and 126, with each segment being arc-shaped to form part of a circle. In some embodiments, some or all of the mounting rings may be arranged in concentric circles and may, as a result, have different diameters. For example, and as shown in FIG. 1B, mounting rings 141-145 may form a first plurality of concentric rings and mounting rings 146-149 may form a second plurality of concentric rings on outer surface 104. The first plurality of concentric rings may overlap with the second plurality of concentric rings (e.g., FIG. 1B depicts ring 145 overlapping with ring 149). Similarly, and as shown in FIG. 1D, mounting rings 161-165 may form a first plurality of concentric rings and mounting rings 166 and 167 may form a second plurality of concentric rings on inner surface 105. In some embodiments, each mounting ring on endcap 100 may have a different diameter. Alternatively, endcap 100 may include two or more rings with the same or substantially the same diameter. For example, one of mounting rings 141-145 may have the same or substantially the same diameter as one of mounting rings 146-149.

Although the embodiment shown in FIGS. 1A-1D includes mounting rings on both outer surface 104 and inner surface 105 of endcap body 102, alternative embodiments of the endcap may include mounting rings only on outer surface 104 or only on inner surface 105. Further, the number, shape, diameter, or other characteristics of the mounting rings may vary to accommodate pipes of one or more desired diameters with a single endcap. In the example shown, endcap 100 includes nine mounting rings 141-149 on outer surface 104 and seven mounting rings 161-167 on inner surface 105. However, other embodiments of the endcap may include more or fewer mounting rings. The plurality of mounting rings 141-149 and 161-167 may have diameters in a range between about 4 inches to about 60 inches. For example, the mounting rings may have diameters of about 4 inches, 6 inches, 8 inches, 10 inches, 12 inches, 14 inches, 15 inches, 16 inches, 18 inches, 21 inches, 24 inches, 30 inches, 32 inches, 36 inches, 40 inches, 45 inches, 48 inches, 50 inches, 55 inches, or 60 inches.

As shown in FIG. 1A, endcap 100 may additionally include markings 140 for the mounting rings. In some embodiments, markings 140 may correspond to a given mounting ring and may connect the different segments that form the mounting ring. As a result, the mounting rings may form complete circles when viewed from the front of the endcap 100 (see FIG. 1B). Markings 140 may include any suitable type of visible indicator, such as raised surfaces, indented surfaces, and/or surface marking applied to the surface of the endcap (e.g., a colored marking).

Figure 2A:
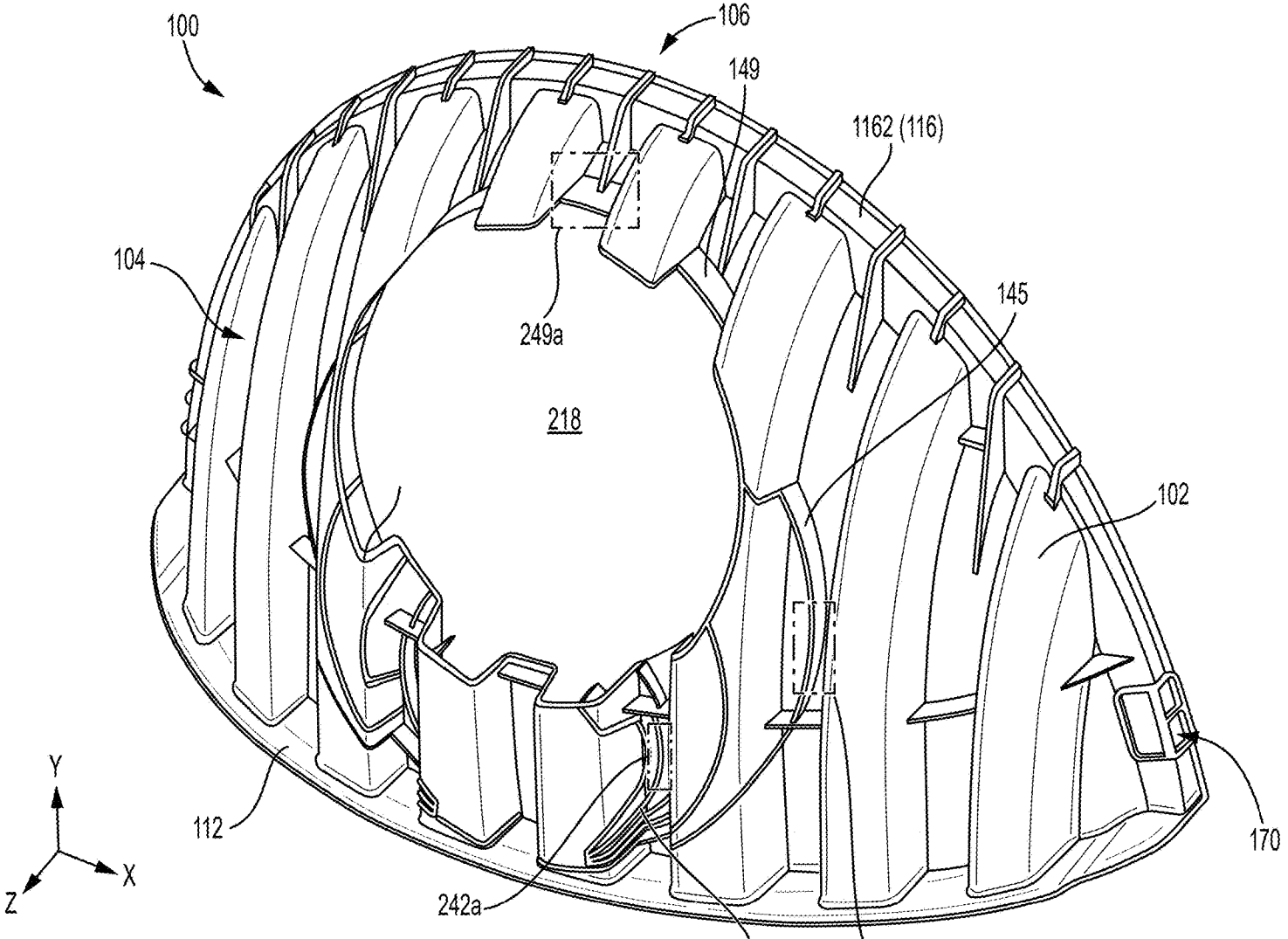
FIG. 2A is a front, top, right perspective view of the endcap of FIG. 1A with an opening formed therein, consistent with disclosed embodiments.

As mentioned above, the mounting rings may be configured to accommodate, or to encircle and hold, fluid pipes of different sizes. Specifically, to use a mounting ring to accommodate a fluid pipe, the user may first determine which of the mounting rings has a diameter equal to the outer diameter of the pipe (this is possible because the respective diameters of the mounting rings are known). Once a mounting ring is identified, the portion of endcap body 102 situated within that mounting ring may be removed by known techniques, such as cutting or drilling, in order to form an opening in the endcap. In some embodiments, the markings 140 of the identified mounting ring may act as a cut guide along which the endcap body can be cut to form the opening. For example, FIG. 2A depicts an example of an endcap 100 in which the interior of mounting ring 149 is removed from endcap body 102 to form an opening 218 in the endcap. The mounting ring 149 may extend around opening 218, so that the mounting ring (and the opening) may receive the fluid pipe. Since the diameter of the mounting ring is equal to the outer diameter of the fluid pipe, the pipe may then be placed within the opening in the endcap, so that the outer surface of the fluid pipe is encircled and held by the mounting ring.

Figure 2B:
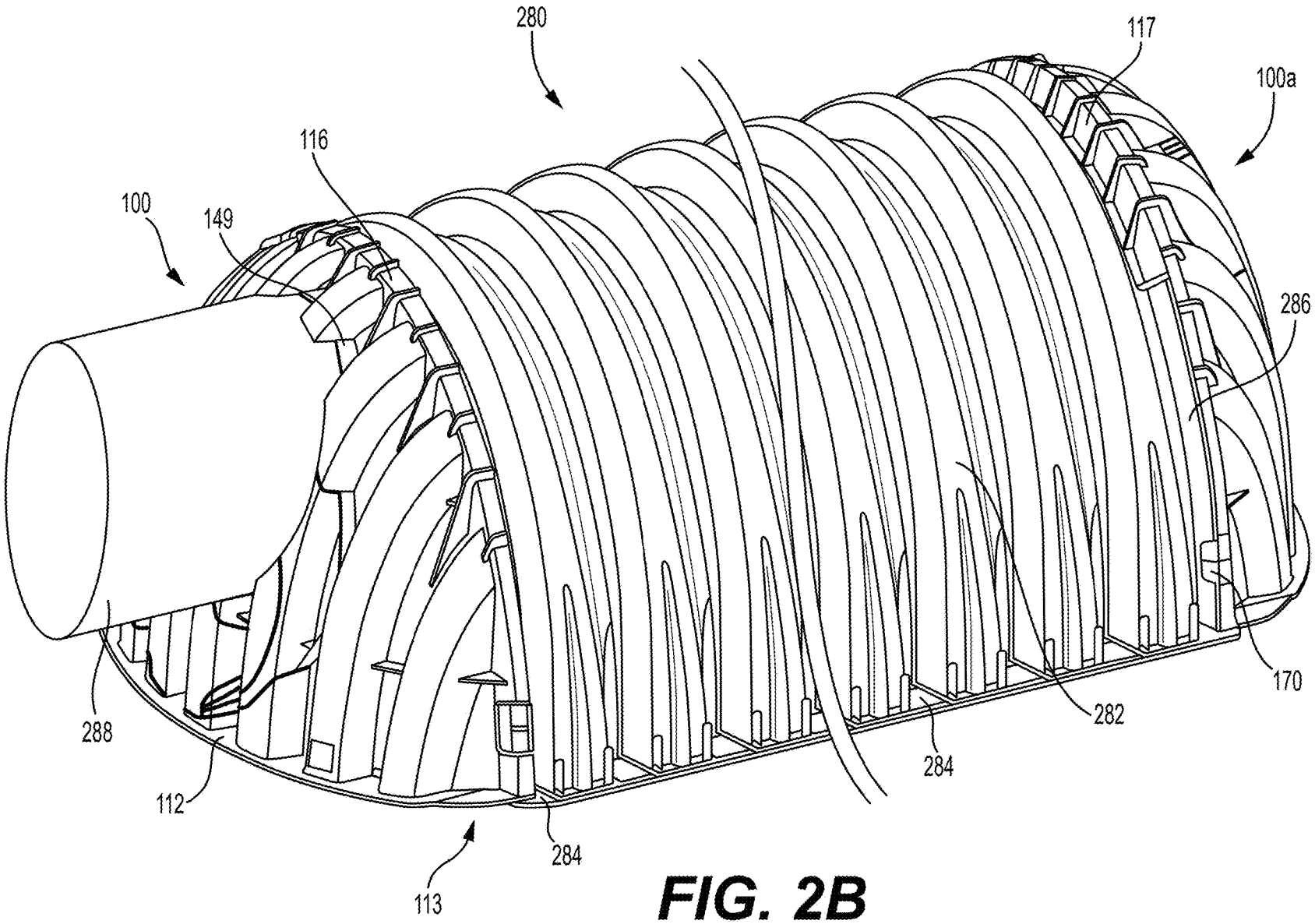
FIG. 2B is a perspective view of a stormwater chamber with the endcap of FIG. 2A, consistent with disclosed embodiments.

For example, FIG. 2B depicts an embodiment in which a fluid pipe 288 is fitted into an opening in an endcap 100. The fluid pipe 288 may therefore be used to deliver material into, receive material from, or transport material through a stormwater chamber 280 (discussed in detail below). The mounting ring on the endcap 100 that corresponds to the fluid pipe 288 (e.g., mounting ring 149 in FIGS. 2A and 2B) may hold and secure the fluid pipe 288 and maintain the fluid pipe 288 at the desired orientation relative to the endcap 100. In some embodiments, the fluid pipe may be secured to the mounting ring and/or to another part of the endcap in a fluid-tight manner via, e.g., a gasketed connection, an elastomeric seal, a glue connection, a primer connection, a solvent welded connection, one or more mechanical fasteners, and/or by friction fit. In some embodiments, the connection between the mounting ring and the fluid pipe may be a permanent or fixed connection. Alternatively, the fluid pipe may be detachably coupled to the mounting ring. Although both the fluid pipe 288 and opening 218 are illustrated as having circular profiles, other profiles may be used depending on the desired implementation of the stormwater chamber 280. In other embodiments the opening 218 and a cross-section of the fluid pipe 288 may be, for example, ovoid, curvilinear, arch-shaped or polygonal.

In disclosed embodiments, at least one of the mounting rings on outer surface 104 may align with one of the mounting rings on inner surface 105, such that the rings are part of the same circle. For example, outer mounting ring 142 may align with inner mounting ring 162, such that the two mounting rings 142, 162 have the same diameter and are situated on the same portion of endcap body 102. Thus, the aligned mounting rings 142, 162 may act together to hold the same fluid pipe.

Advantageously, the plurality of mounting rings on the endcap 100 allow the endcap to accommodate pipes of different sizes or diameters. Further, in disclosed embodiments, the mounting rings of endcap 100 are configured to accommodate a variety of types of fluid pipes, including corrugated pipes, smooth wall pipes, single wall pipes, dual wall pipes, and triple wall pipes. The mounting rings may also accommodate fluid pipes constructed from any suitable material, including polyethylene, polypropylene, resin, and metal.

Endcap 100 may be construed of plastic (e.g., polyethylene) or any other suitable material. In some embodiments, endcaps of the present disclosure may be formed by a lie-flat injection molding process as a unitary structure. For example, endcap 100 (including mounting rings 141-149 and 161-167) may be formed all at once, such as from a single mold. Thus, the mounting rings do not need to be attached to the endcap 100 after the fact. Additionally, or alternatively, endcap 100 may be formed of the same material, formed during a single molding process, and/or without any additional construction post-molding (apart from the formation of opening 218).

FIG. 2B depicts an assembled stormwater chamber 280 formed from a chamber body 282 with endcaps 100, 100*a* attached at both ends. Stormwater chamber 280 may be configured for placement beneath the surface of the earth to receive and temporarily store rainwater and other fluids (referred to herein as "runoff") from one or more surface level drains. In the embodiment shown, chamber body 282 may be an open-bottom chamber with a side wall having a round or polygonal cross-section and with a foot 284 along the open-bottom end. Over time, chamber 280 may disperse the runoff stored therein by percolation into the surrounding ground through the open bottom of chamber body 282. In some embodiments, chamber body 282 may be corrugated and may be constructed of plastic (e.g., polypropylene, HDPE, LDPE, PVC), metal, and/or any other suitable material.

Endcaps 100, 100*a* may be shaped and configured to mate with the ends of chamber body 282 to close off the chamber and prevent entry of undesired matter into the chamber. The endcaps may be situated with their respective concave inner surfaces 105 facing towards chamber body 282, such that interior volume 108 of each endcap is open to the interior volume of the chamber body. For example, in the embodiment shown in FIG. 2B, one or both of the endcaps may connect to an end of chamber body 282 in an overlapping configuration, such that teeth 117 on inner rim 116 of the endcap may be placed over and lock onto chamber body rim 286 located at the end of chamber body 282. In some embodiments, latches 170 of the endcap may be similarly placed over chamber body rim 286 to help secure endcap 100 to chamber body 282. Further, indents 113 formed in endcap foot 112 may be placed on top of chamber body foot 284, so that endcap foot 112 and chamber body foot 284 are substantially even. As mentioned above, at least one of endcaps 100, 100*a* may include a fluid pipe 288 passing through an opening formed in the endcap. Fluid pipe 288 may cantilever outwardly from outer surface 104 of the endcap for connection to a line that carries fluid to or from chamber 280. In alternative embodiments, multiple pipes may be fitted into endcap 100. In further alternative embodiments, at least one pipe may be fitted into both endcaps 100, 100*a*.

In some disclosed embodiments, the wall of the endcap body has a parabolic profile in at least one dimension. For example, the wall of the endcap body may have a parabolic profile in two dimensions. As used herein, the phrase "parabolic profile" refers to the wall of the endcap body being curved in the shape (or substantially in the shape) of a true mathematical parabola, which is a locus of points that are equidistant from a fixed point (a focus) and a fixed line (directrix), with the focus not lying on the directrix. Such parabolas are not just generally U-shaped, but they also meet the mathematical definition of a parabola. Further, as used herein, having a parabolic profile "in two dimensions" refers to the endcap body being shaped as a parabola when viewed in a first plane, and also being shaped as a parabola when viewed in a second plane perpendicular to the first plane.

Figure 3A:
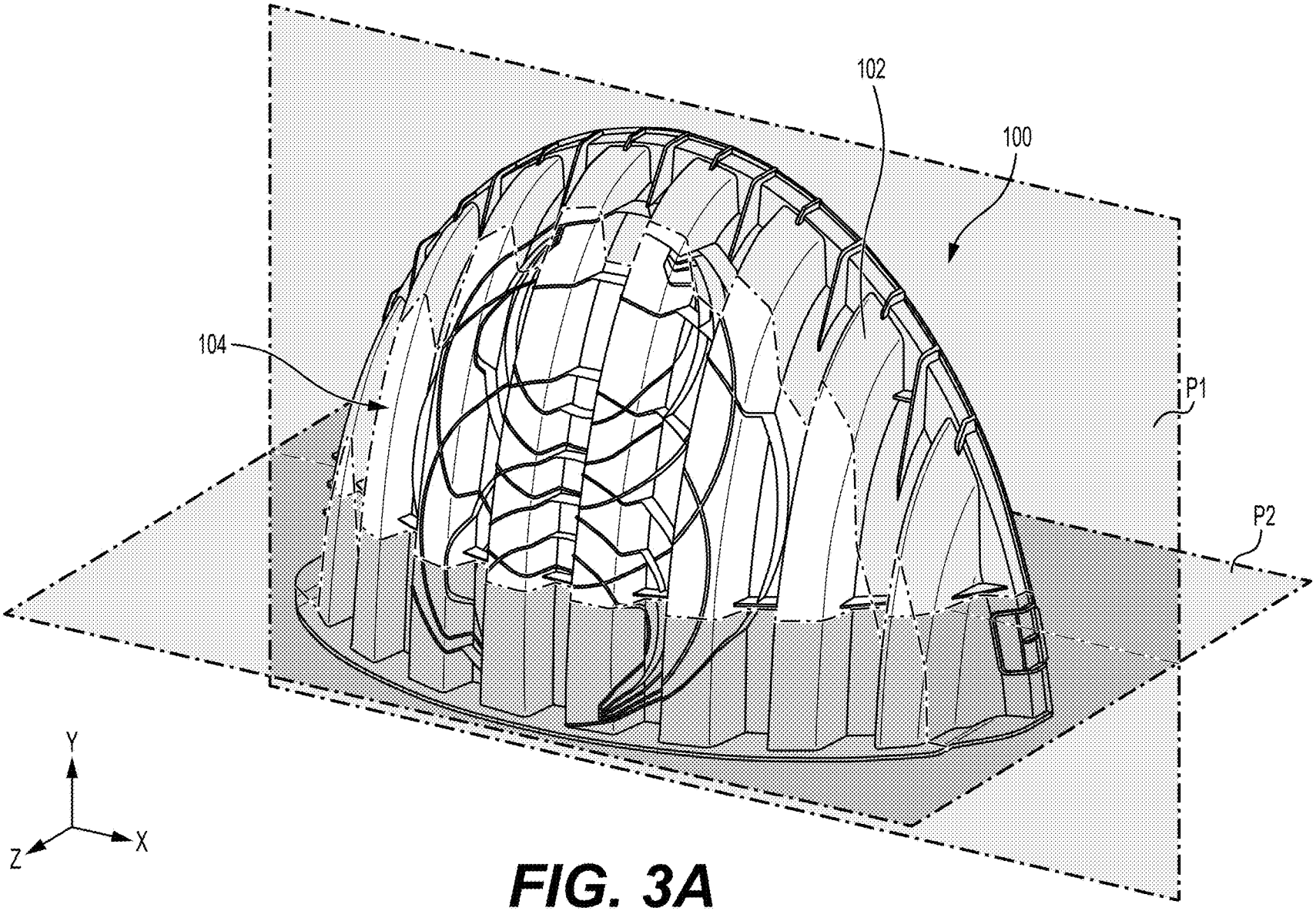
FIG. 3A is a front, top, right perspective view of the endcap of FIG. 1A with a vertical reference plane P1 and a horizontal reference plane P2, consistent with disclosed embodiments.
Figure 3B:
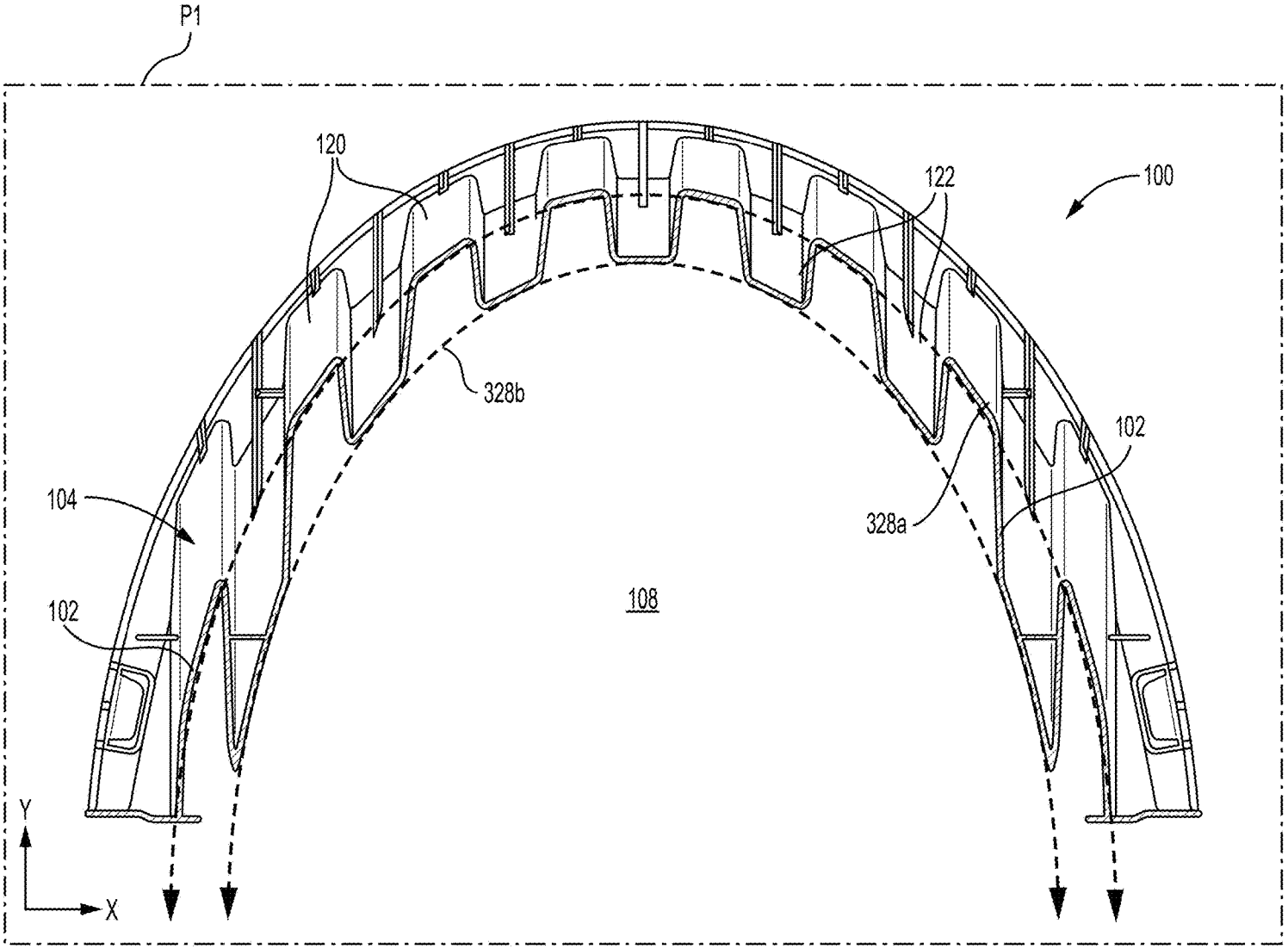
FIG. 3B is a cross-sectional front view of the endcap along plane P1, as indicated in FIG. 3A.

To illustrate, FIG. 3A depicts endcap 100 with reference planes P1 and P2 that intersect with (i.e., pass through) endcap body 102. Reference plane P1 is a vertical plane in the x- and y-directions, and reference plane P2 is a horizontal plane in the x- and z-directions (e.g., plane P2 may be parallel to endcap foot 112 in some embodiments). In some embodiments, endcap body 102 has a parabolic profile in the x- and y-directions. Thus, in any vertical plane P1 passing through endcap body 102, the resulting cross-section of endcap body 102 is shaped as a true mathematical parabola. For example, FIG. 3B depicts a cross-section of endcap 100 along the reference plane P1 shown in FIG. 3A. In FIG. 3B, the parts of endcap body 102 along the corrugation peaks 120 are curved along a first parabola 328*a*. Similarly, the parts of endcap body 102 along the corrugation valleys 122 are curved along a second parabola 328*b*, which may have the same characteristics or different characteristics as first parabola 328*a*. In some embodiments, and as mentioned above, the entire endcap body 102 may have a parabolic profile in the x- and y-directions (not just the cross-section depicted in FIG. 3B).

Figure 3C:
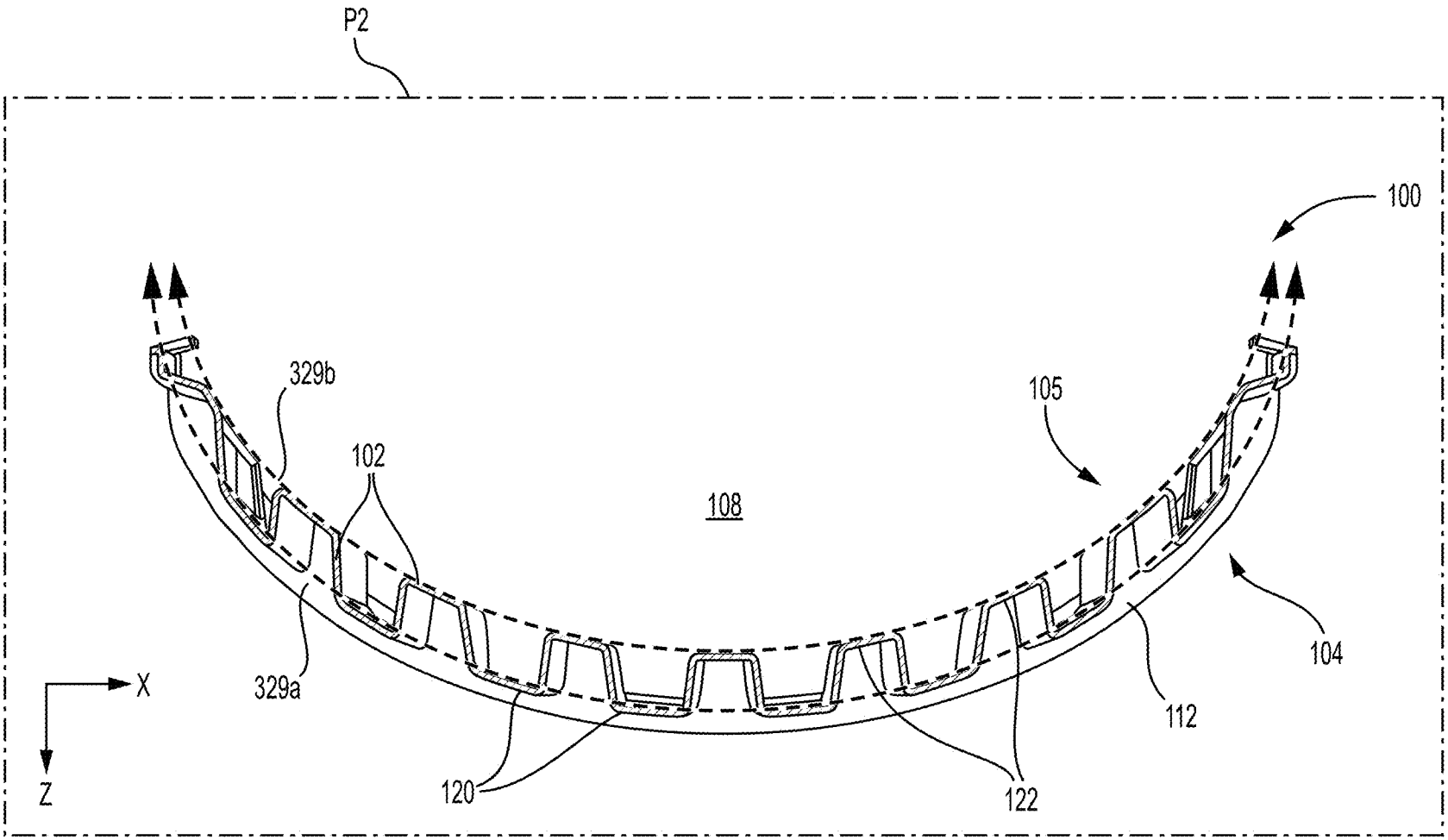
FIG. 3C is a cross-sectional top view of the endcap along plane P2, as indicated in FIG. 3A.

Endcap body 102 also has a parabolic profile in the x- and z-directions. Accordingly, in any horizontal plane P2 passing through endcap body 102, the resulting cross-section of endcap body 102 is also shaped as a true mathematical parabola. For example, FIG. 3C depicts a cross-section of endcap 100 along reference plane P2 in FIG. 3A. In FIG. 3C, the parts of endcap body 102 along corrugation peaks 120 are curved along a first parabola 329*a*. Similarly, the parts of endcap body 102 along corrugation valleys 122 are curved along a second parabola 329*b*, which may have the same characteristics or different characteristics as first parabola 329*a*. In some embodiments, and as mentioned above, the entire endcap body 102 may have a parabolic profile in the x- and z-directions (not just the single cross-section depicted in FIG. 3C).

Advantageously, configuring the endcap body 102 to have a parabolic profile in two dimensions enables endcap 100 to distribute applied loads across its body, while also providing increased volume within the endcap (e.g., maximizing the size of interior volume 108) and enabling the endcap to have minimal clearance when stacked with other endcaps, thus maximizing shipping efficiency. As a result of the aforementioned load distribution, the outer-most portions of the endcap (such as outer ends 107) are more resistant to premature failure when the endcap is in use with a stormwater chamber. This allows the endcap to avoid the problem of having areas of localized weakness, which is an issue experienced by previous stormwater chamber endcaps lacking the parabolic profile of the present disclosure. Further, as a result of the aforementioned volume of the endcap, a stormwater chamber having the endcap is able to collect and retain more water.

In alternative embodiments, the wall of the endcap body may be curved into a different shape. For example, the wall of the endcap body (e.g., endcap body 102) may have a parabolic profile in one dimension and a different shape (such as an arch or semicircle) in the second dimension. Or, as another example, the wall of the endcap body (e.g., endcap body 102) may have a different shape (e.g., an arch or semicircle) in the two dimensions thereof.

Figure 4A:
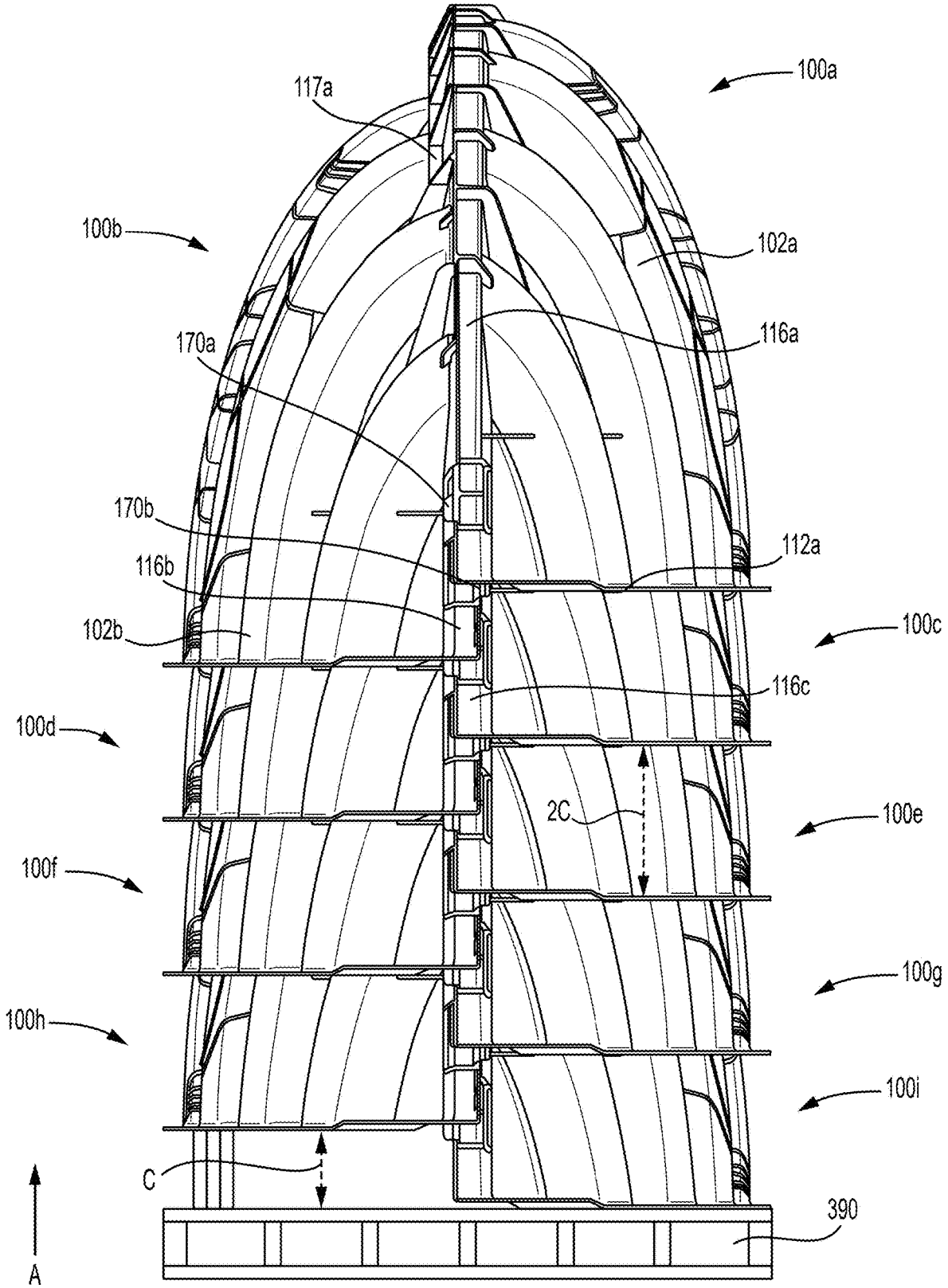
FIG. 4A is an elevation view of a first plurality of nested endcaps in a vertically-stacked configuration, consistent with disclosed embodiments.
Figure 4B:
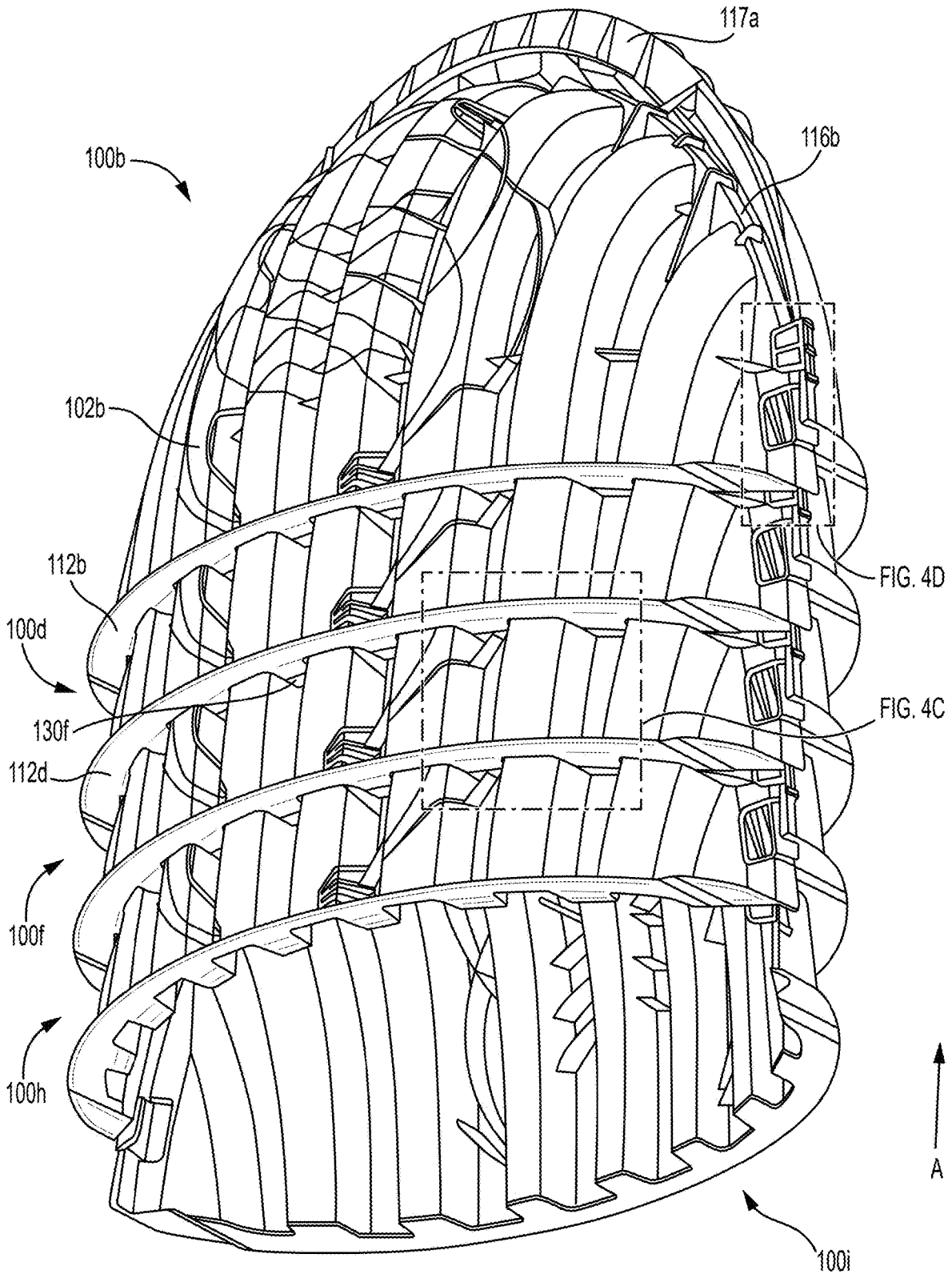
FIG. 4B is a perspective view of the stack of nested endcaps shown in FIG. 4A, consistent with disclosed embodiments.
Figure 4C:
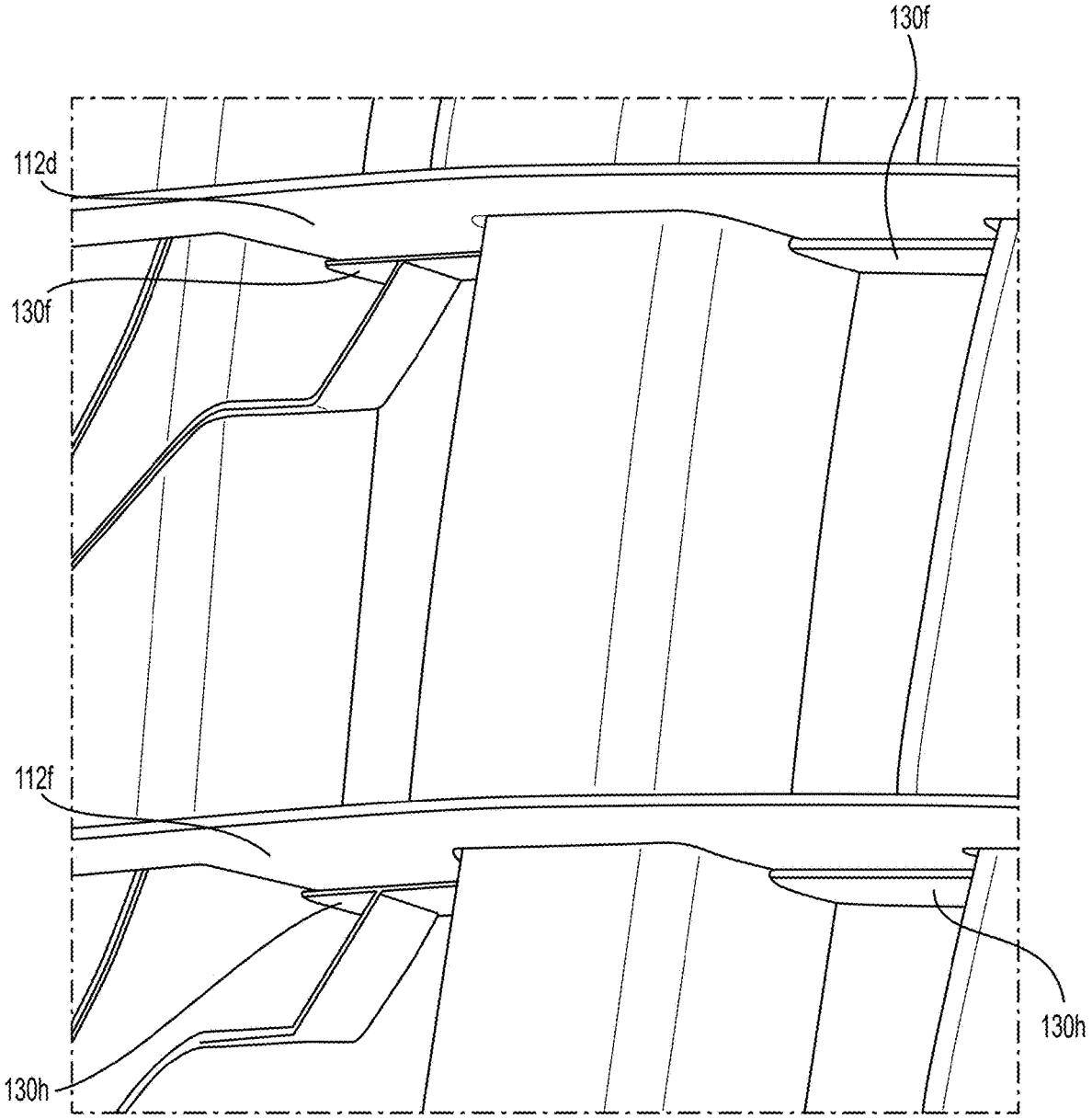
FIG. 4C is a first enlarged view of the stack of nested endcaps, as indicated in FIG. 4B.

In some disclosed embodiments, the endcap is configured to be nested or stacked together with one or more additional endcaps (i.e., the endcap is "stackable") in such a manner that the body of the endcap does not contact the body of any other endcap in the stack. This capability allows multiple endcaps to be stored and transported in a secure and efficient manner, but without the endcaps damaging each other. For example, FIGS. 4A and 4B depict a plurality of endcaps 100*a*-100*i* that are stacked or nested together along a vertical stacking direction A; the stack may be placed atop a support structure 390. Some or all of endcaps 100*a*-100*i* in the stack may be identical or substantially identical. In the embodiment shown, each endcap may be arranged opposite from the next endcap in the stack, such that the two endcaps face in opposite directions. For example, a first endcap 100*a* may be arranged opposite from the next endcap in the stack, second endcap 100*b*, such that the interior of endcaps 100*a* and 100*b* face toward each other and the interior volume (not shown) of first endcap 100*a* communicates with and is open to the interior volume (also not shown) of second endcap 100*b*. Similarly, second endcap 100*b* may be opposite from a third endcap 100*c*, which may be situated directly beneath first endcap 100*a*. In some disclosed embodiments, endcaps 100*a*-100*i* may be vertically stacked in vertical stacking direction A with foot 112 of a given endcap resting upon nesting ribs 130 of the endcap directly beneath it. For example, FIG. 4C shows an enlarged view of foot 112*d* of endcap 100*d* resting upon nesting ribs 130*f* of endcap 100*f*. Similarly, foot 112*f* of endcap 100*f* may rest upon nesting ribs 130*h* of endcap 100*h* beneath it.

With reference back to FIGS. 4A and 4B, the latches 170 of each endcap may engage with a receiving projection (e.g., inner rim 116) of the next endcap in the stack. For example, latches 170*a* of a first endcap 100*a* may wrap around the inner rim 116*b* of a second endcap 100*b*, which is the next endcap in the stack and is immediately opposite from first endcap 100*a*. Optionally, the latching teeth 117*a* extending from the inner rim 116*a* of first endcap 100*a* may also wrap around the receiving projection (e.g., inner rim 116*b*) of second endcap 100*b*. The latches 170*b* of second endcap 100*b* may, in turn, engage with a receiving projection (e.g., inner rim 116*c*) of the next endcap in the stack, which may be the third endcap 100*c* directly beneath the first endcap 100*a*. Advantageously, the engagement of the latches of each endcap in the stack with the receiving projection (e.g., inner rim) of the next endcap may secure the endcap against rotational movement relative to the next endcap, thus keeping the stack of endcaps structurally sound and preventing it from collapsing.

Due to the parabolic shape of the corrugated wall of endcap body 102, only a small clearance is required between the endcap body of each endcap in the stack. This capability allows the endcaps to be stacked very efficiently, such that the stack does not take up a lot of space. For example, in the embodiment shown in FIG. 4A, a vertical clearance C of around six (6) inches is maintained between two adjacently-stacked endcaps, such as endcaps 100*g* and 100*h*. Thus, a vertical clearance of around twelve (12) inches is maintained between a stacked endcap and the endcap directly above or below it (e.g., between endcaps 100*c* and 100*e*). Since this vertical clearance prevents the bodies of the endcaps from contacting each other in the stack, there is a reduced risk of the endcaps damaging each other during the stacking process or while the endcaps remain stacked together. Instead, at least one of the foot 112 or the inner rim 116 of a given endcap may serve as the point(s) of contact with other endcaps in the stack. For example, in the embodiment shown in FIGS. 4A and 4B, the only contact between the stacked endcaps 100*a*-100*i* is the aforementioned engagement of latches 170 (and optionally teeth 117) with the receiving projection (e.g., inner rim 116) of the next endcap in the stack, as well as foot 112 of each endcap resting on nesting ribs 130 of the endcap directly beneath it. Due to the strength of the latching engagement between latches 170 and the receiving projection (e.g., inner rim 116), the entire corrugated wall of a given endcap may be held apart from the corrugated walls of the endcaps above it and beneath it in the stack.

Figure 4D:
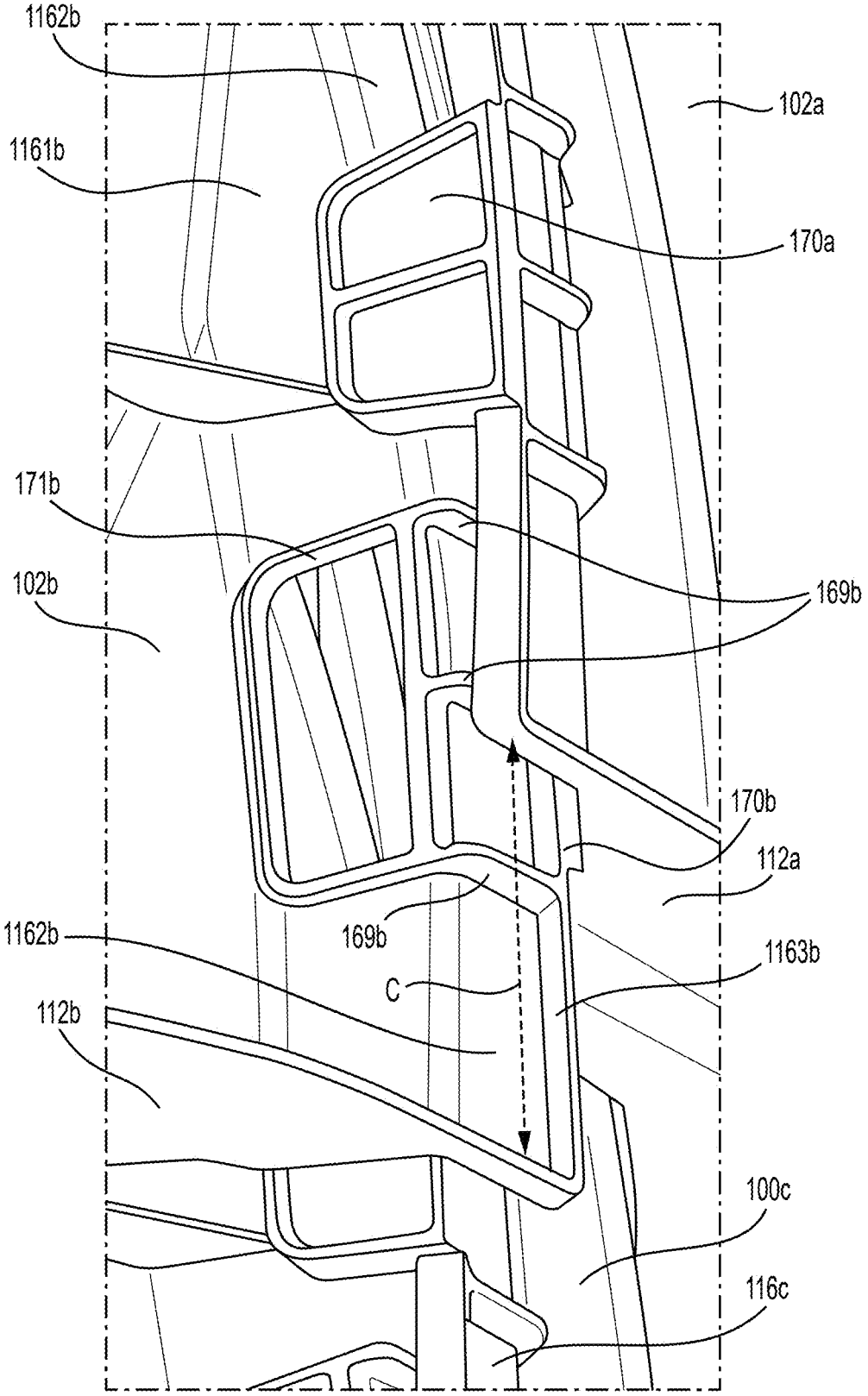
FIG. 4D is a second enlarged view of the stack of nested endcaps, as indicated in FIG. 4B.

For example, FIG. 4D depicts an enlarged view of the latching engagement between first endcap 100*a* and second endcap 100*b*. Latch 170*a* of first endcap 100*a* may wrap around the outward-facing second surface 1162*b* and the upstanding lip 1163*b* of second endcap 100*b*, and in some embodiments the inner surface of the latch 170*a* may rest flush with the first surface 1161*b* of the second endcap 100*b*. This engagement holds first endcap 100*a* against rotating relative to second endcap 100*b*, thus preventing first endcap 100*a* from bringing the corrugated wall of its endcap body 102*a* into contact with the endcaps stacked above or beneath it. The vertical clearance C of around six (6) inches is therefore maintained between the adjacently-stacked endcaps 100*a* and 100*b*. Similarly, the engagement between the latches 170*b* of second endcap 100*b* and the rim 116*c* of third endcap 100*c* may prevent damage to its corrugated endcap body 102*b*. To further stabilize the stack of endcaps, foot 112*a* of first endcap 100*a* may rest on the nesting ribs of third endcap 100*c*, foot 112*b* of second endcap 100*b* may rest on the nesting ribs of a fourth endcap 100*d*, etc.

As mentioned above in reference to FIG. 1F, the placement of latches 170 on endcap 100 may also contribute to the stacking efficiency of the endcap. For example, an angle θ (see FIG. 1F) defined between the latch 170 and the lower-most end of endcap 100 may have a value between 5-degrees and 15-degrees (e.g., angle θ may equal, or substantially equal, 8-degrees, 9-degrees, 10-degrees, or some other value). Advantageously, configuring endcap 100 to have the aforementioned value of angle may provide the optimized balance between maximizing stacking efficiency and minimizing the risk of endcap damage. To illustrate in reference to FIG. 4D, latch 170*a* may be placed on endcap 100*a* such that the angle between latch 170*a* and the lower-most end of endcap 100*a* may equal angle θ discussed above. The value of angle θ for latch 170*a* may be small enough that endcap 100*a* can achieve the aforementioned vertical clearance from other endcaps in the stack, but large enough that latch 170*a* can have a sufficiently strong grip on the inner rim of endcap 100*b* to securely hold the stack together. Further, value of angle θ for latch 170*a* is also large enough that latch 170*a* is kept from touching (and possibly damaging) features on endcap 100*b*, such as latch 170*b*, lip 171*b*, the corrugations in endcap body 102, and latch-reinforcing ribs 169*b* shown in FIG. 4D (which may strengthen the connection between latch 170*b* and endcap 100*b*).

In some embodiments, the mounting rings on the endcap are configured to remain spaced apart from (i.e., out of contact with) other endcaps in the stack. For example, each mounting ring may have a respective depth that is smaller than the distance between two adjacent endcaps in the stack. This capability allows the endcaps to be stacked without damaging any of the mounting rings. In some embodiments, the depth of a given mounting ring may vary as a function of position along the wall of the endcap body 102. That is, one section of a given mounting ring may have a different depth than another section of the same mounting ring. This variability allows the mounting ring to have a larger depth in areas where there is more clearance between the mounting ring and the next endcap in the stack, while also reducing the mounting ring depth in areas with less clearance to avoid contact with the next endcap.

To illustrate, FIG. 2A depicts endcap 100 with an opening 218 formed within mounting ring 149 (discussed above). Some or all of the mounting rings 141-149 and 161-167 of endcap 100 may have a variable depth (here, the term "depth" referring to a dimension of the ring in the z-direction). In some embodiments, the part of a mounting ring furthest from the endcap body center 106 may be the part of the mounting ring with the smallest depth. For example, ring segment 245*a* in FIG. 2A may be the portion of mounting ring 145 with the smallest depth. Similarly, ring segment 242*a* may be the portion of mounting ring 142 with the smallest depth. Additionally, or alternatively, ring segment 249*a* located at the endcap body center 106 may be the portion of mounting ring 149 with the largest depth.

FIGS. 5A-5D depict another embodiment of an endcap 500 consistent with the present disclosure. Like endcap 100, endcap 500 may be a stackable endcap of a stormwater chamber for holding and discharging stormwater. Endcap 500 may have similar features and capabilities as endcap 100, apart from the differences discussed below. For sake of brevity, discussion of redundant features and characteristics has been omitted.

Figure 5A:
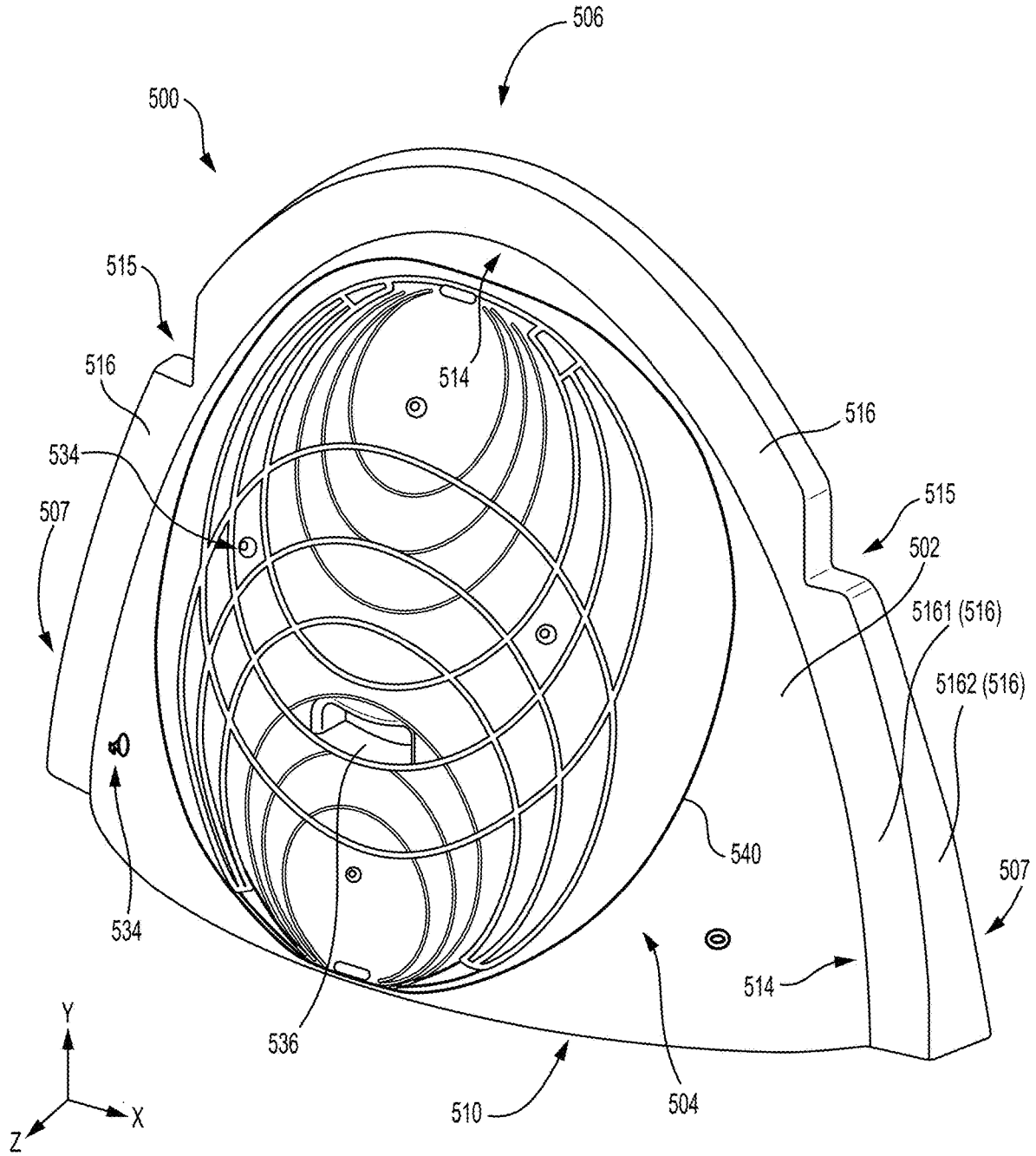
FIG. 5A is a front, top, right perspective view of a second example of an endcap of a stormwater chamber, consistent with disclosed embodiments.
Figure 5B:
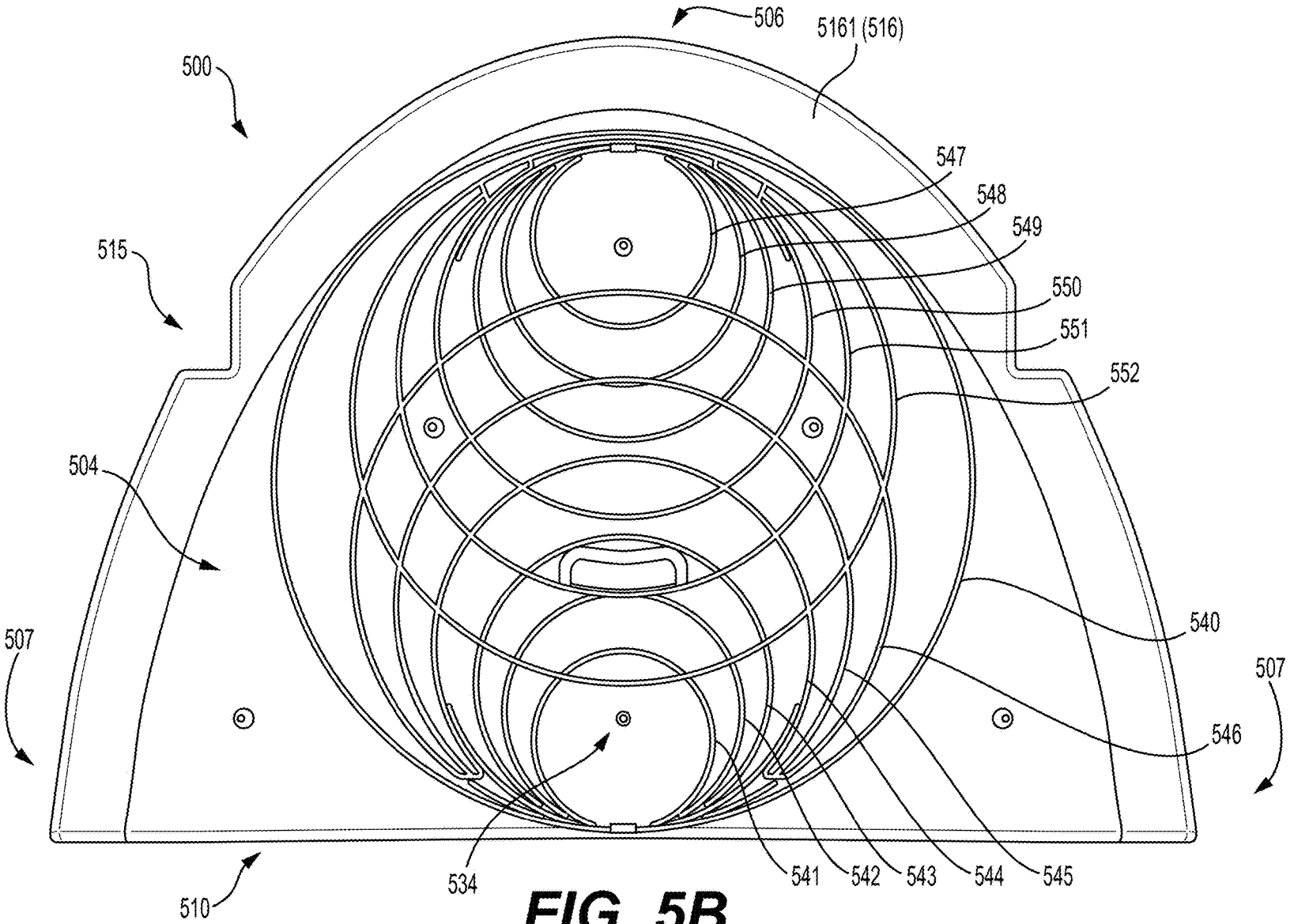
FIG. 5B is a front elevation view of the endcap of FIG. 5A, consistent with disclosed embodiments.
Figure 5C:
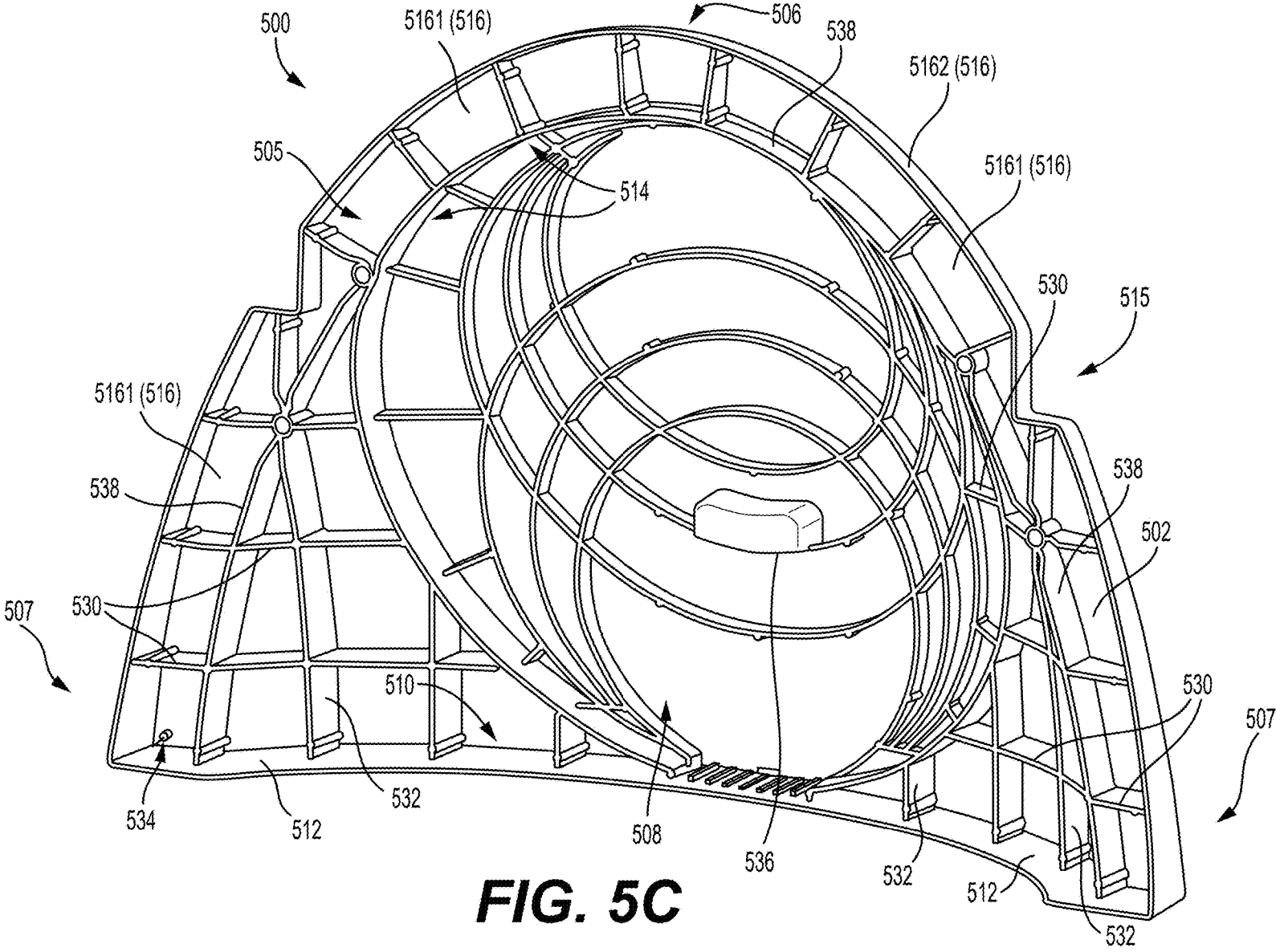
FIG. 5C is a rear, top, left perspective view of the endcap of FIG. 5A, consistent with disclosed embodiments.
Figure 5D:
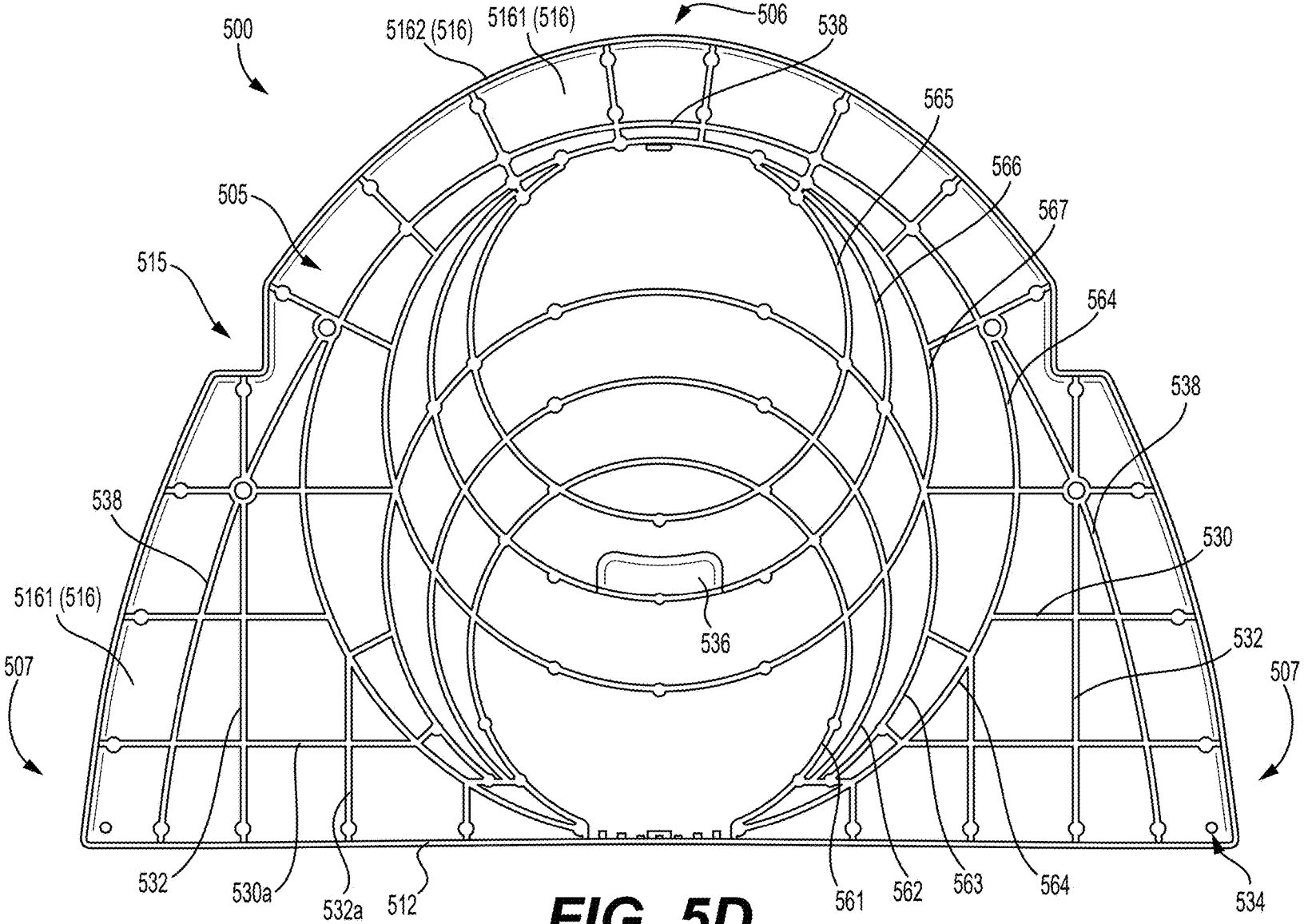
FIG. 5D is a rear elevation view of the endcap of FIG. 5A, consistent with disclosed embodiments.

FIGS. 5A and 5B depict a convex outer surface 504 of the body 502 of endcap 500, and FIGS. 5C and 5D depict a concave inner surface 505 of the body 502 of endcap 500. As shown in FIG. 5C, the concave inner surface 505 of the endcap body may define an interior volume 508. In disclosed embodiments, a substantially planar foot 512 may extend from the lower edge 510 of endcap body 502, on the inner side of the endcap body. Further, a protruding inner rim 516 may run along the inner edge 514 of endcap body 502. In some embodiments, inner rim 516 may include a first surface 5161 that is perpendicular to, or substantially perpendicular to, foot 512; and a second surface 5162 facing outward from the endcap 500. Additionally, or alternatively, inner rim 516 may include at least one indent 515 for holding a support structure (discussed further below in reference to FIG. 8B).

In some embodiments, endcap 500 may have a width (along the x-direction) within a range between 10 inches and 125 inches. For example, one non-limiting embodiment of endcap 500 may have a width of between 15 inches and 55 inches. Alternatively, the width of endcap 500 may be larger or smaller. In some embodiments, endcap 500 may have a height (along the y-direction) within a range between 8 inches and 80 inches. For example, one non-limiting embodiment of endcap 500 may have a height of between 10 inches and 35 inches. Alternatively, the height of endcap 500 may be larger or smaller. In some embodiments, endcap 500 may have a depth (along the z-direction) within a range between 3 inches and 45 inches. For example, one non-limiting embodiment of endcap 500 may have a depth of between 4 inches and 15 inches. Alternatively, the depth of endcap 500 may be larger or smaller.

Similar to endcap 100 discussed above in reference to FIB. 2B, endcap 500 is configured to connect to an end of a chamber body 282 to form a stormwater chamber 280 for holding and discharging stormwater. Further, an opening may be formed in endcap 500 and a fluid pipe 288 may be fitted into the opening so that the fluid pipe may be used to deliver materials into, or receive materials from, the stormwater chamber 280. Endcap 500 may include at least one mounting ring (discussed further below) that encircles and holds the fluid pipe 288 and which may maintain the fluid pipe 288 at the desired orientation relative to endcap 500. In some embodiments, endcap 500 may be configured to connect to an end of chamber body 282 in an underlapping configuration to form the stormwater chamber 280. That is, endcap 500 may be situated within the opening at the end of the chamber body 282 so that the rim 286 of the chamber body is situated on top of the inner rim 516 of endcap 500. Inner rim 516 of endcap 500 may be received within the rim 286 of the chamber body in a male-female arrangement to secure the endcap 500 to the chamber body 282. In some embodiments, additional features such as teeth or latches may be provided on one of the chamber body 282 or endcap 500 to further secure their connection.

In disclosed embodiments, one or both of convex outer surface 504 or concave inner surface 505 may be substantially flat. As used herein, the phrase "substantially flat" means that the surfaces of endcap 500 lack the corrugations present in endcap 100 and are instead smooth. In some embodiments, additional features of endcap 500 may be provided on the substantially flat outer surface 504 or inner surface 505. For example, and as shown in FIG. 5A, at least one handle 536 may be provided on outer surface 504 near the center 506 of endcap 500. Additionally, or alternatively, one or both of outer surface 504 or inner surface 505 may include at least one mounting ring. For example, FIG. 5B depicts endcap body 502 having a plurality of mounting rings 541-552 protruding from outer surface 504. Further, FIG. 5D depicts a plurality of mounting rings 561-567 protruding from inner surface 505. Mounting rings 541-552 and 561-567 may each be configured to hold a fluid pipe extending through an opening in endcap 500, as discussed above with regard to the mounting rings of endcap 100. Although the embodiment shown in FIGS. 5A-5D includes mounting rings on both outer surface 504 and inner surface 505, alternative embodiments of endcap 500 may include mounting rings only on the outer surface 504 or only on the inner surface 505. Further, the number, shape, diameter, or other characteristics of the mounting rings may vary to accommodate pipes of one or more desired diameters with endcap 500.

In some embodiments, at least one mounting ring may form a complete circle along the substantially flat outer surface or inner surface of the endcap. Additionally, or alternatively, at least one mounting ring may be arc-shaped to form part of a circle. In some embodiments, some or all of the mounting rings may be arranged in concentric circles and may, as a result, have different diameters. For example, and as shown in FIG. 5B, rings 541-546 may form a first group of concentric mounting rings and rings 547-552 may form a second group of concentric mounting rings. In some embodiments, at least one mounting ring from the first group (e.g., ring 546) may overlap with at least one mounting ring from the second group (e.g., ring 552), or vice versa. In some embodiments, at least one mounting ring of endcap 500 may have a depth that varies as a function of position along the wall of endcap body 502 (similar to the mounting rings discussed above with regard to FIG. 2A). Additionally, or alternatively, at least one mounting ring of endcap 500 may have a constant depth.

In some embodiments, at least one mounting ring on the outer surface 504 may align with one of the mounting rings on inner surface 505, such that the rings are part of the same circle. For example, outer mounting ring 546 may align with inner mounting ring 563, such that the two mounting rings 546 and 563 may act together to hold the same fluid pipe passing through an opening in endcap 500. In some embodiments, endcap 500 may include at least one marking 540 serving as a cut line for forming an opening of a specified size in endcap 500.

As shown in FIGS. 5C and 5D, endcap 500 may include a plurality of nesting ribs 530, 532 extending from the concave inner surface 505 of the wall of endcap body 502. Nesting ribs 530 may run laterally (i.e., horizontally) along at least a portion of the inner surface 505 between the outer ends 507 of endcap 500. Additionally, or alternatively, nesting ribs 532 may run vertically along at least a portion of the inner surface 505 between foot 512 and inner rim 516. Nesting ribs 530, 532 may assist with stacking the endcap 500 with one or more additional endcaps (discussed in further detail below). Additionally, nesting ribs 530, 532 may increase the structural integrity of the endcap 500 against damage or deformation caused by externally-applied loads. In some embodiments, at least one lateral rib (designated in FIG. 5D as rib 530*a*) may extend laterally, and without interruption, between second surface 5162 of the inner rim and an outer-most mounting ring 564. Additionally, or alternatively, at least one vertical rib (designated in FIG. 5D as rib 532*a*) may extend vertically, and without interruption, between the outer-most mounting ring 564 and one of the foot 512 or inner rim 516 of endcap 500. In some embodiments, endcap 500 may include at least one additional rib on inner surface 505. For example, FIGS. 5C and 5D depict an inner rim boundary rib 538 extending along inner edge 514 of the endcap body 502, on the inner surface 505 of the endcap. In some embodiments, one or both of convex outer surface 504 and concave inner surface 505 may include at least one contoured pin 534, which may assist with stacking the endcap 500 with one or more additional endcaps (discussed in further detail below).

Figure 6A:
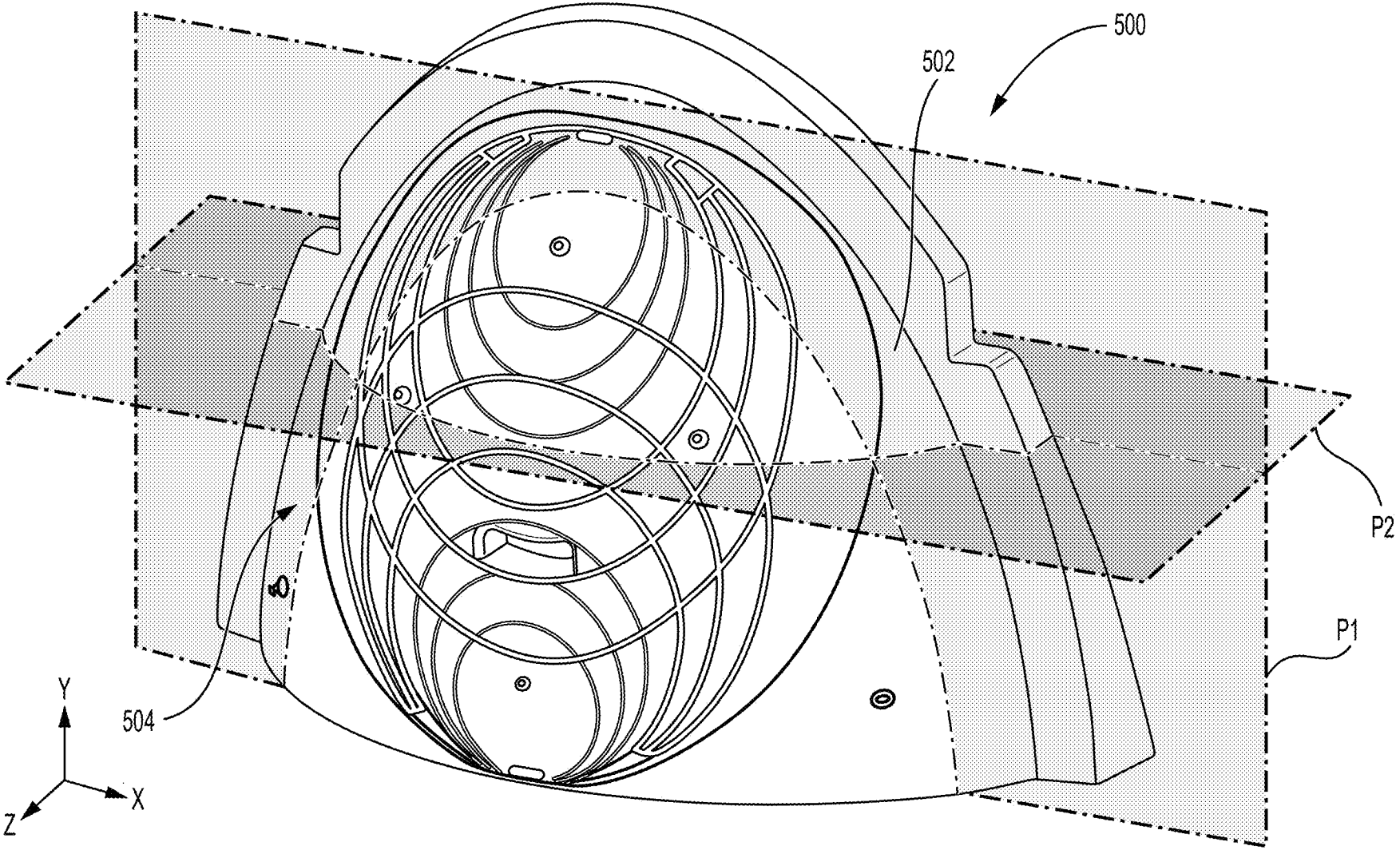
FIG. 6A is a front, top, right perspective view of the endcap of FIG. 5A with a vertical reference plane P1 and a horizontal reference plane P2, consistent with disclosed embodiments.
Figure 6B:
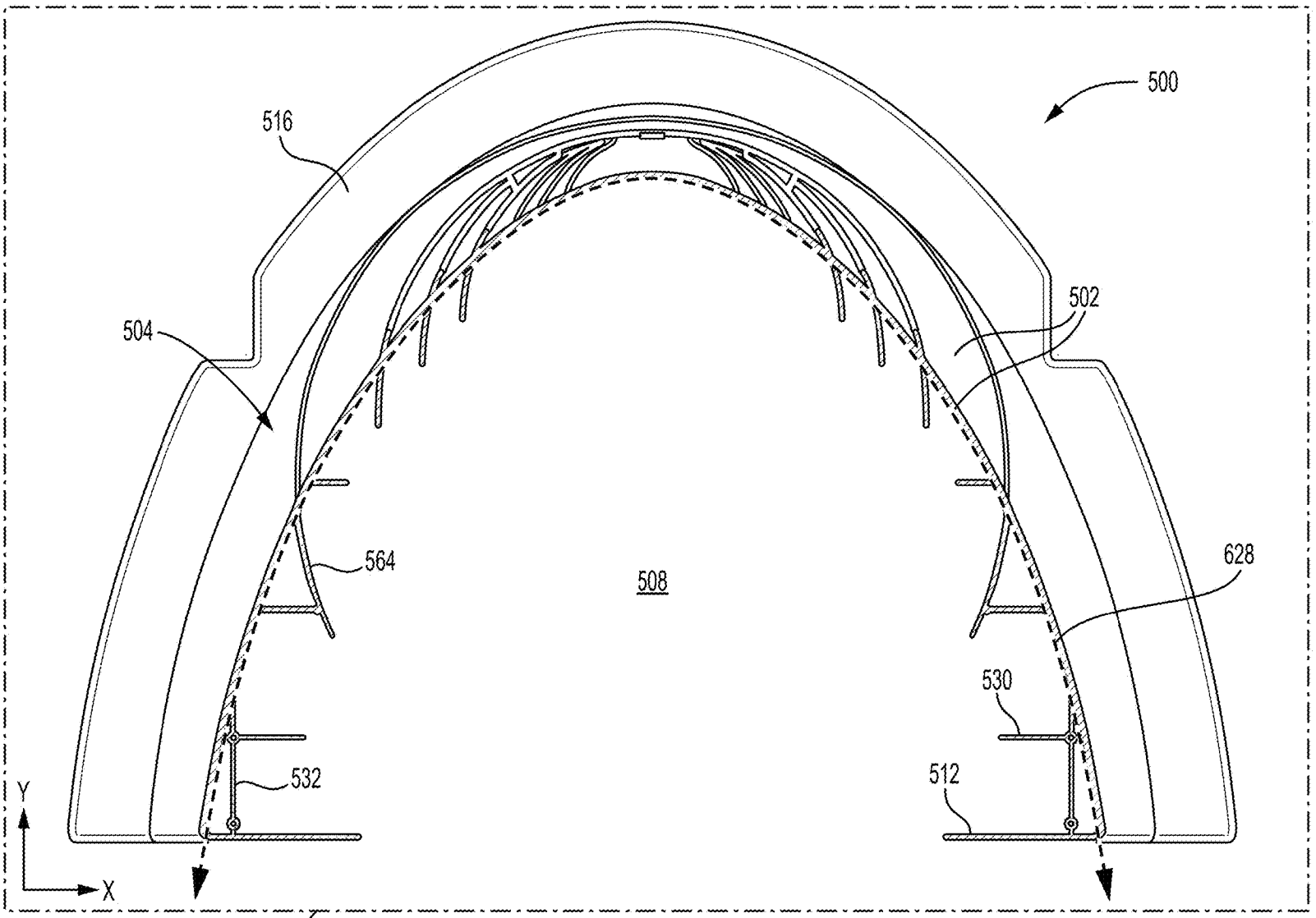
FIG. 6B is a cross-sectional front view of the endcap along plane P1, as indicated in FIG. 6A.
Figure 6C:
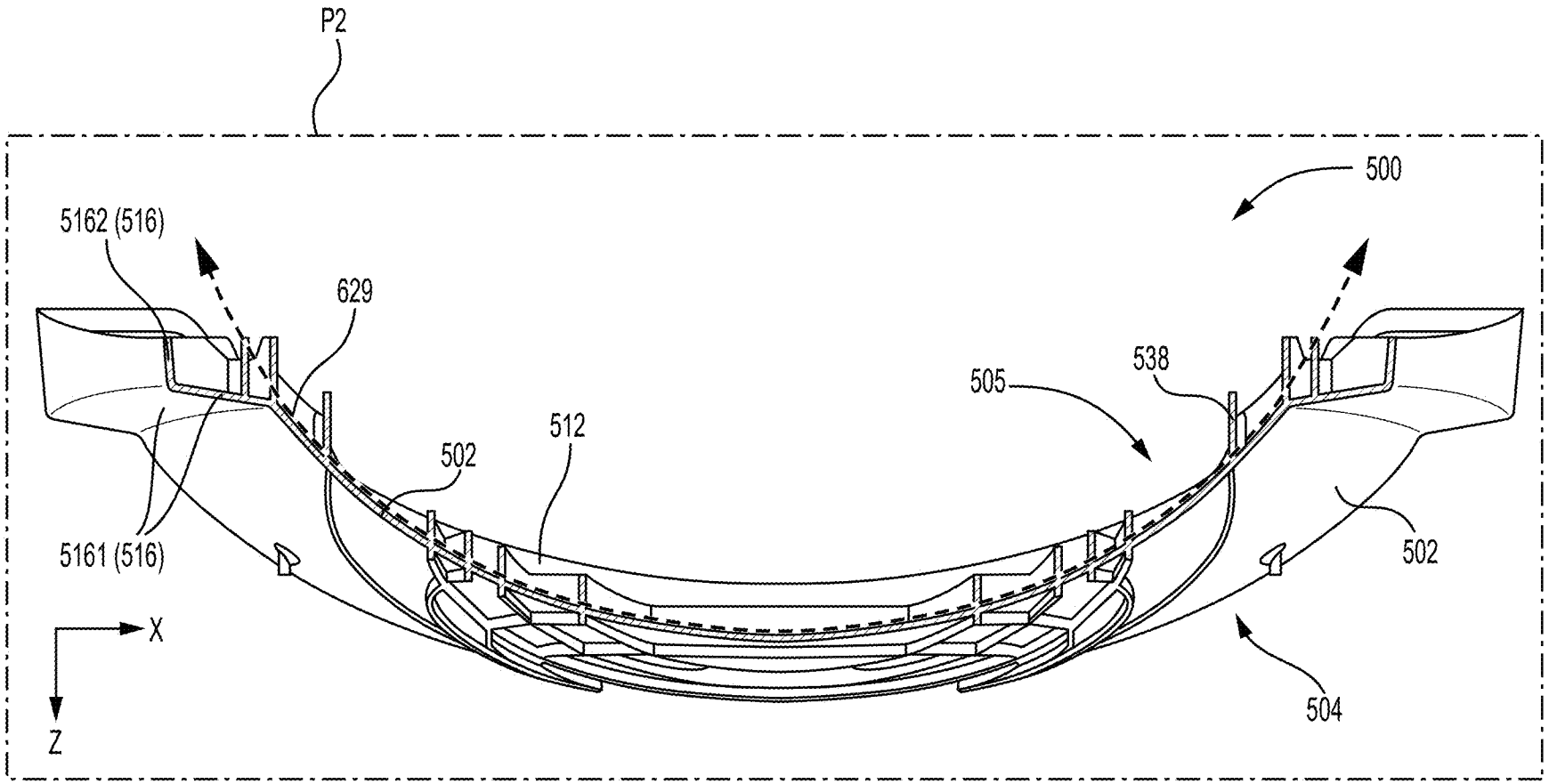
FIG. 6C is a cross-sectional top view of the endcap along plane P2, as indicated in FIG. 6A.

In some embodiments, the wall of endcap body 502 has a parabolic profile in at least one dimension (as defined above in reference to FIGS. 3A-3C). For example, the wall of endcap body 502 may have a parabolic profile in two dimensions. To illustrate, FIGS. 6A-6C depict endcap 500 with reference planes P1 and P2 that intersect with (i.e., pass through) endcap body 502. In some embodiments, endcap body 502 has a parabolic profile in the x- and y-directions. Thus, in any vertical plane P1 passing through the endcap body 502, the resulting cross-section of endcap body 502 is shaped (or substantially shaped) as a true mathematical parabola. For example, FIG. 6B depicts a cross-section of endcap 500 along the reference plane P1 shown in FIG. 6A. In FIG. 6B, the wall of endcap body 502 is curved along a parabola 628. In some embodiments, and as mentioned above, the entire endcap body 502 has a parabolic profile in the x- and y-directions (not just the cross-section of FIG. 6B).

In some embodiments, endcap body 502 also has a parabolic profile in the x- and z-directions. Accordingly, in any horizontal plane P2 passing through endcap body 502, the resulting cross-section of endcap body 502 is also shaped (or substantially shaped) as a true mathematical parabola. For example, FIG. 6C depicts a cross-section of endcap 500 along reference plane P2 in FIG. 6A. In FIG. 6C, the wall of endcap body 502 is curved along a parabola 629. In some embodiments, and as mentioned above, the entire endcap body 502 may have a parabolic profile in the x- and z-directions (not just the cross-section of FIG. 6C). Advantageously, and like endcap body 102 discussed above, configuring endcap body 502 to have a parabolic profile in two dimensions enables the endcap 500 to distribute applied loads across its body, while also providing increased volume within endcap 500 and enabling endcap 500 to have minimal clearance when stacked with other endcaps, thus maximizing shipping efficiency.

In alternative embodiments, the wall of endcap body 502 may be curved into a different shape. For example, the wall of endcap body 502 may have a parabolic profile in one dimension and a different shape (such as an arch or semicircle) in the second dimension. Or, as another example, the wall of endcap body 502 may have a different shape (e.g., an arch or semicircle) in the two dimensions thereof.

Figure 7A:
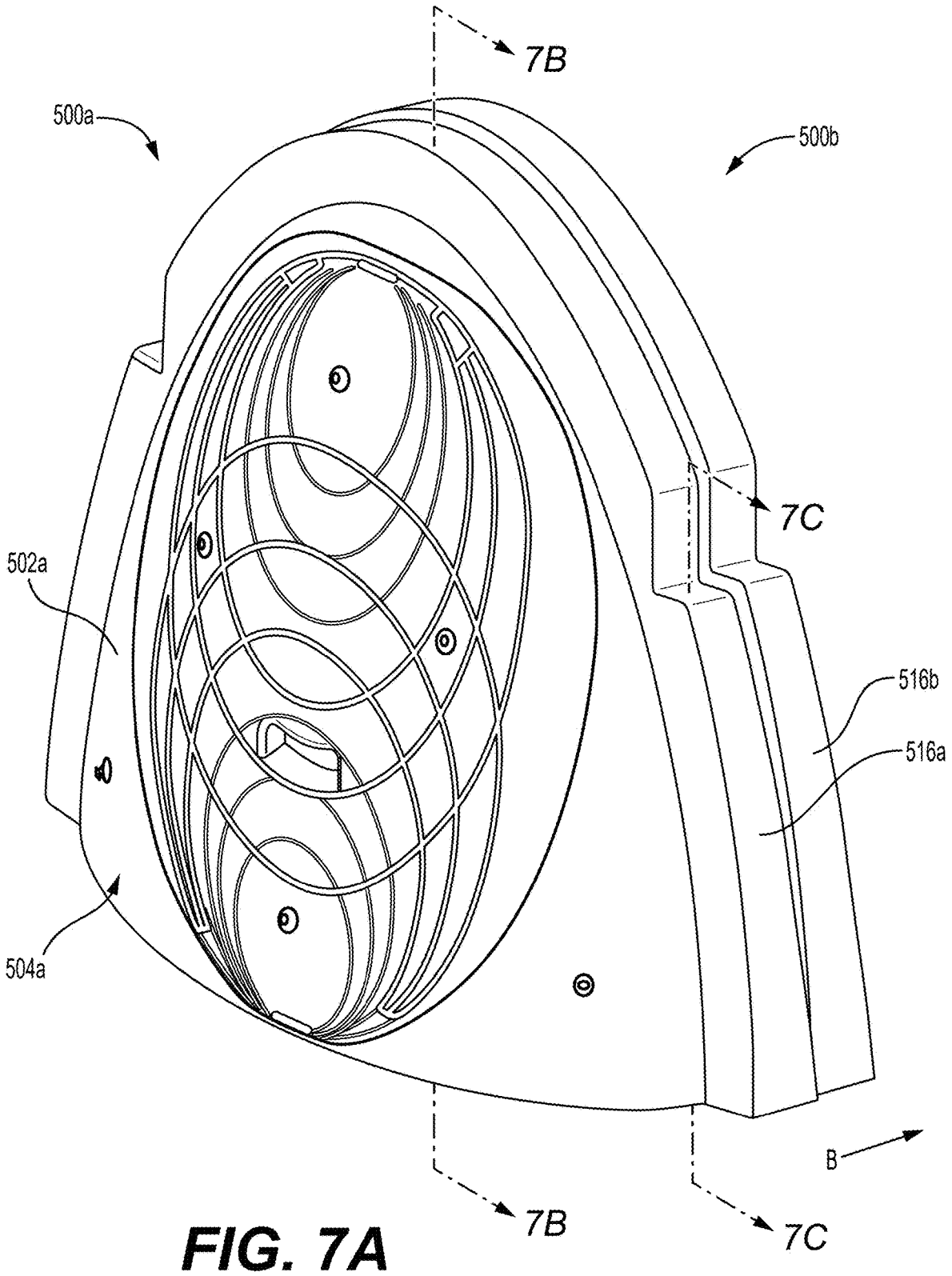
FIG. 7A is a perspective view of the endcap of FIG. 5A nested with a second, identical endcap, consistent with disclosed embodiments.
Figure 7B:
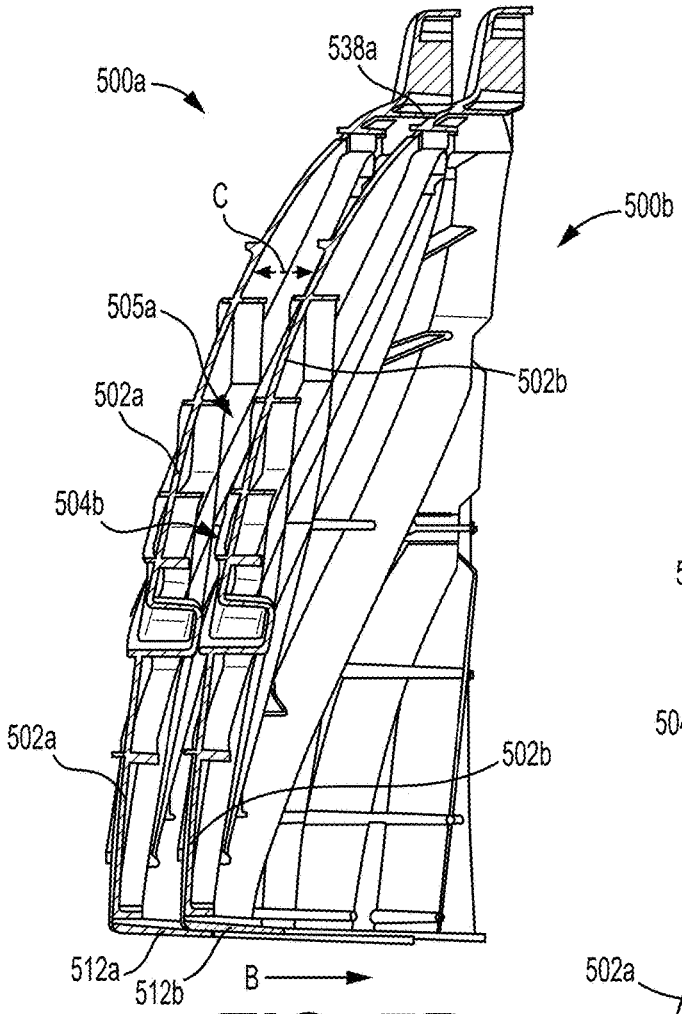
FIG. 7B is a first cross-sectional side view of the nested endcaps, as indicated in FIG. 7A.
Figure 7C:
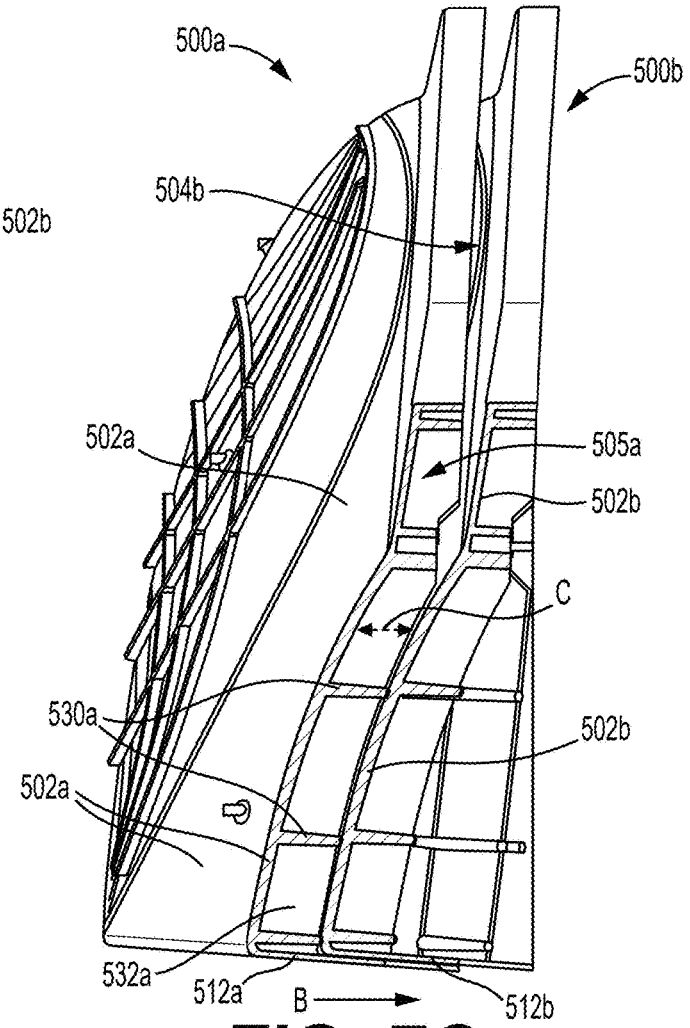
FIG. 7C is a second cross-sectional side view of the nested endcaps, as indicated in FIG. 7A.

In disclosed embodiments, the parabolic shape of endcap 500 shown in FIGS. 5A-5D enables the endcap to be nested or stacked together with one or more additional endcaps (i.e., the endcap 500 is "stackable") in such a manner that the body of the endcap does not contact the body of any other endcap in the stack. This capability allows multiple endcaps to be stored and transported in a secure and efficient manner, but without the endcaps damaging each other. In some embodiments, endcap 500 may be configured to stack or nest with one or more additional endcaps in a horizontal stacking direction. For example, FIGS. 7A-7C depict two endcaps 500*a* and 500*b* stacked together along a horizontal stacking direction B; endcaps 500*a* and 500*b* may be identical or substantially identical. In the horizonal stacking configuration shown in FIGS. 7A-7C, the outer surface 504*b* of the second endcap 500*b* is placed within the interior volume of the first endcap 500*a* with the second endcap foot 512*b* resting atop the first endcap foot 512*a*, such that the outer surface 504*b* of the second endcap 500*b* is adjacent to the inner surface 505*a* of the first endcap 500*a*. Due to this horizontal stacking capability, only a small clearance is required between two stacked endcaps. For example, in the embodiment shown in FIGS. 7B and 7C, a horizontal clearance C of around 2.5 inches is maintained between two adjacently-stacked endcaps, such as endcaps 500*a* and 500*b*. Additional endcaps may similarly be stacked against endcaps 500*a* and 500*b* to form a horizontal stack (depicted in FIGS. 8A and 8B).

As shown in the cross-sectional views of FIGS. 7B and 7C, the ribs 530*a*, 532*a*, and 538*a* on the inner surface of the first endcap may hold the second endcap 500*b* away from the body 502*a* of the first endcap, thus keeping the endcaps from damaging each other. For example, in the cross-section shown in FIG. 7B, the only points of contact between the endcaps are at their respective feet 512*a* and 512*b* and at a point near the top where the inner rim boundary rib 538*a* of the first endcap rests against the outer surface of the second endcap 500*b*. Additionally, the cross-section of FIG. 7C shows the horizontal ribs 530*a* and vertical ribs 532*a* of the first endcap abutting the outer surface 504*b* of the second endcap, which holds the endcap body 502*a* of the first endcap away from the second endcap 500*b*.

Figure 8A:
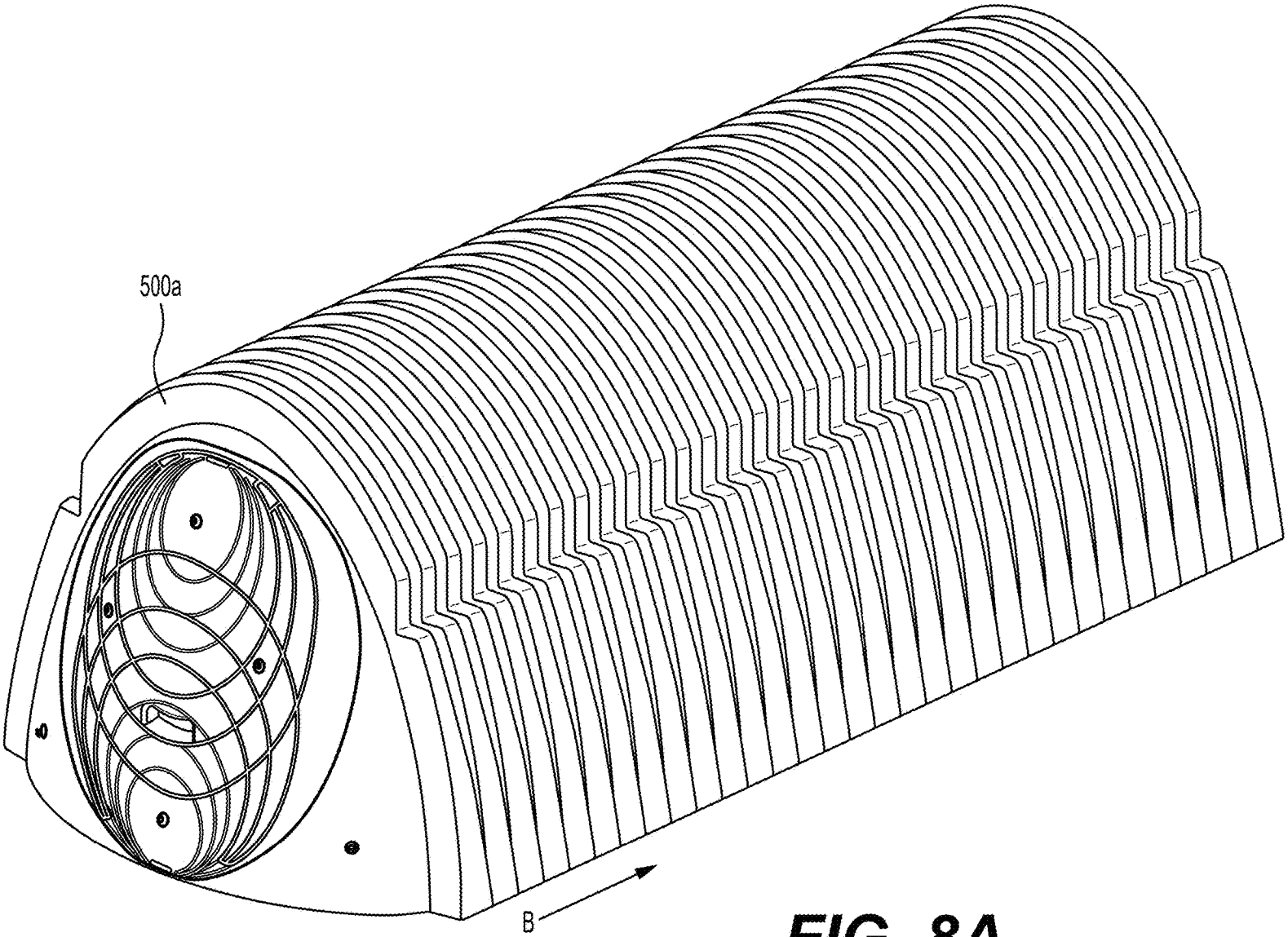
FIG. 8A depicts a second plurality of nested endcaps in a horizontally-stacked configuration, consistent with disclosed embodiments.
Figure 8B:
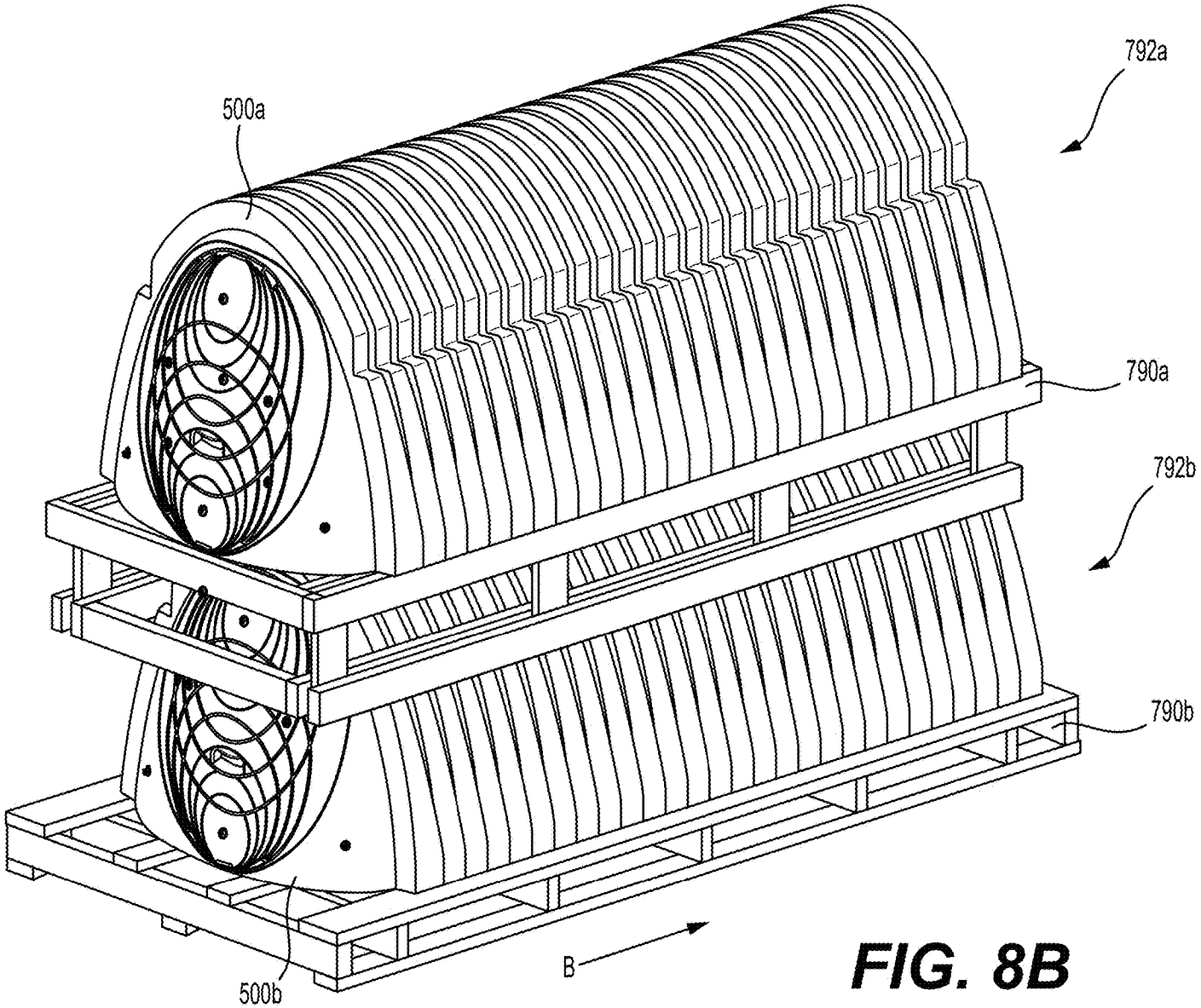
FIG. 8B depicts a first group of horizontally-stacked endcaps, stacked vertically atop a second group of horizontally-stacked endcaps.

As shown in FIG. 8A, additional endcaps may be stacked with a first endcap 500*a* along the horizontal stacking direction B to form a horizontal stack of endcaps 792*a*. In some embodiments, and as shown in FIG. 8B, the first horizontal stack 792*a* may be placed on a support structure 790*a*. To optimize the use of space, support structure 790*a* may be vertically stacked on top of a second horizontal stack of endcaps 792*b*, which may similarly be formed by stacking additional endcaps with a first endcap 500*b* along the horizontal stacking direction B. In some embodiments, support structure 790*a* of the first horizontal stack 792*a* may sit in the inner rim indents 515 of the endcaps in the second horizontal stack 792*b*. The second horizontal stack 792*b* may, in turn, be placed on a second support structure 790*b*. If desired, one or more additional horizontal stacks of endcaps, each with their own support structure, may be added on top of first horizontal stack 792*a* and/or beneath second horizontal stack 792*b*.

The foregoing description has been presented for purposes of illustration. It is not exhaustive and is not limited to precise forms or embodiments disclosed. Modifications and adaptations of the embodiments will be apparent from consideration of the specification and practice of the disclosed embodiments. While certain components have been described as being coupled to one another, such components may be integrated with one another or distributed in any suitable fashion.

Although this disclosure has been shown and described with respect to the detailed embodiments thereof, it will be understood by those of skill in the art that various changes may be made and that equivalents, modifications, omissions, combinations (e.g., of aspects across various embodiments), adaptations and/or alterations may be added to and/or substituted for elements thereof without departing from the scope of the disclosure. The elements in the claims are to be interpreted broadly based on the language employed in the claims and not limited to examples described in the present specification or during the prosecution of the application, which examples are to be construed as nonexclusive. In addition, modifications may be made to adapt a particular situation or material to the teachings of the disclosure without departing from the essential scope thereof. Further, the steps of the disclosed methods can be modified in any manner, including reordering steps and/or inserting or deleting steps. Therefore, it is intended that the scope of the appended claims not be limited to the particular embodiments disclosed in the above detailed description, but that the scope of the appended claims will include all embodiments falling within the scope of this disclosure.

Other embodiments will be apparent from consideration of the specification and practice of the embodiments disclosed herein. It is intended that the specification and examples be considered as example only, with a true scope and spirit of the disclosed embodiments being indicated by the following claims.

What is claimed is:

1. A stackable endcap of a chamber for holding and discharging stormwater, the stackable endcap comprising:

an endcap body having a wall with a convex outer surface and a concave inner surface, the concave inner surface of the wall defining an interior volume of the stackable endcap;

a substantially planar foot extending from a lower edge of the endcap body;

a protruding inner rim running along an inner edge of the endcap body; and at least one latch comprising a lip and latch-reinforcing ribs, wherein the stackable endcap is configured to be stacked with at least one additional endcap such that at least one of the foot or the inner rim of the stackable endcap contacts at least one latch of the additional endcap while the wall of the endcap body is spaced apart from a wall of the additional endcap.

2. The stackable endcap of claim 1, wherein the stackable endcap is configured to connect to an end of a chamber body in at least one of an overlapping configuration or an underlapping configuration to form the chamber.

3. The stackable endcap of claim 1, wherein the stackable endcap and the at least one additional endcap are stackable in a vertical stacking direction or in a horizontal stacking direction.

4. The stackable endcap of claim 1, wherein the interior volume of the stackable endcap communicates with an interior volume of the additional endcap when the stackable endcap and the additional endcap are stacked together.

5. The stackable endcap of claim 1, wherein the stackable endcap is configured to receive, within the interior volume, an outer surface of the additional endcap when the stackable endcap and the additional endcap are stacked together.

6. The stackable endcap of claim 1, further comprising a plurality of nesting ribs extending from the wall of the endcap body, wherein the nesting ribs are configured to hold the wall of the endcap body apart from the wall of the additional endcap.

7. The stackable endcap of claim 6, wherein at least one of the nesting ribs runs along the concave inner surface of the wall of the endcap body between the foot and the inner rim of the endcap.

8. The stackable endcap of claim 1, further comprising at least one nesting rib extending from the wall of the endcap body, wherein the at least one nesting rib is configured to support a third endcap stacked adjacent to the stackable endcap.

9. The stackable endcap of claim 1, further comprising a plurality of mounting rings protruding from at least one of the convex outer surface of the wall of the endcap body or the concave inner surface of the wall of the endcap body, wherein each mounting ring is configured to hold a fluid pipe extending through an opening in the stackable endcap.

10. The stackable endcap of claim 9, wherein the mounting rings are arranged in a concentric configuration.

11. The stackable endcap of claim 9, wherein a depth of at least one mounting ring, relative to the wall of the endcap body, varies as a function of position along the wall of the endcap body.

12. The stackable endcap of claim 1, wherein the at least one latch is configured to engage with a receiving projection of the additional endcap so as to secure the stackable endcap against movement relative to the additional endcap.

13. The stackable endcap of claim 12, wherein the stackable endcap includes at least two latches that are spaced apart from the lower end of the endcap and which each extend from the inner rim in a laterally inward direction.

14. The stackable endcap of claim 1, wherein the wall of the endcap body has a parabolic profile in at least one dimension.

15. The stackable endcap of claim 1, wherein the wall of the endcap body has a parabolic profile in two dimensions.

16. The stackable endcap of claim 1, wherein the concave inner surface of the endcap body wall and the convex outer surface of the endcap body wall are substantially flat.

17. The stackable endcap of claim 1, wherein the wall of the endcap body forms a plurality of corrugations defined by alternating peaks and valleys emanating from the lower edge of the endcap body to the inner edge of the endcap body, wherein the peaks and valleys have parabolic profiles in two dimensions.

18. The stackable endcap of claim 17, wherein at least one of the corrugation valleys has a variable width.

19. The stackable endcap of claim 17, wherein at least one of the corrugation peaks has a variable width.

20. The stackable endcap of claim 17, further comprising a plurality of nesting ribs running laterally across the corrugation valleys, wherein the nesting ribs are configured to support a third endcap stacked adjacent to the stackable endcap.

21. A system for holding and discharging stormwater, the system comprising:

a stormwater chamber formed from a chamber body and a stackable endcap connected to an end of the chamber body, wherein the stackable endcap comprises:

an endcap body having a wall with a convex outer surface and a concave inner surface, the concave inner surface of the wall defining an interior volume of the stackable endcap that is open to an interior volume of the chamber;

a substantially planar foot extending from a lower edge of the endcap body;

a protruding inner rim running along an inner edge of the endcap body; and at least one latch comprising a lip and latch-reinforcing ribs, wherein the stackable endcap is configured to be stacked with at least one additional endcap such that at least one of the foot or the inner rim of the stackable endcap contacts at least one latch of the additional endcap while the wall of the endcap body is spaced apart from a wall of the additional endcap.

22. The system of claim 21, further comprising:

a fluid pipe extending through an opening in the endcap body of the stackable endcap, wherein the stackable endcap includes a plurality of mounting rings protruding from at least one of the outer surface of the wall or the inner surface of the wall, wherein one of the mounting rings encircles and holds the fluid pipe.

* * * * *